US008584985B2

(12) United States Patent
Woolley et al.

(10) Patent No.: US 8,584,985 B2
(45) Date of Patent: Nov. 19, 2013

(54) LAUNCH SYSTEM

(75) Inventors: Christopher Colin Anthony Woolley, Preston (GB); Kevin William Beggs, Preston (GB); Ryan Andrew Bakewell, Preston (GB); Richard Desmond Joseph Axford, Shrivenham (GB); John Wainwright, Hexham (GB)

(73) Assignee: BAE Systems PLC, London (GB)

( * ) Notice: Subject to any disclaimer, the term of this patent is extended or adjusted under 35 U.S.C. 154(b) by 394 days.

(21) Appl. No.: 12/992,506

(22) PCT Filed: May 13, 2009

(86) PCT No.: PCT/GB2009/050507

§ 371 (c)(1),
(2), (4) Date: Nov. 12, 2010

(87) PCT Pub. No.: WO2009/138787

PCT Pub. Date: Nov. 19, 2009

(65) Prior Publication Data

US 2011/0062281 A1 Mar. 17, 2011

(30) Foreign Application Priority Data

May 13, 2008 (EP) ..... 08275016
May 13, 2008 (GB) ..... 0808641.5

(51) Int. Cl.
*B64F 1/04* (2006.01)

(52) U.S. Cl.
USPC ..... 244/63; 244/49; 89/1.13

(58) Field of Classification Search
USPC ..... 244/49, 63, 62; D21/107; 89/1.13, 1.34
See application file for complete search history.

(56) References Cited

U.S. PATENT DOCUMENTS

| | | | | | |
|---|---|---|---|---|---|
| 2,426,437 | A | * | 8/1947 | Cole et al. | 446/65 |
| 2,708,431 | A | * | 5/1955 | Walker | 124/22 |
| 2,748,529 | A | | 6/1956 | Swan | |
| 3,068,612 | A | * | 12/1962 | Simpson | 446/65 |
| 3,496,580 | A | * | 2/1970 | Gulmon | 441/85 |
| 3,568,191 | A | * | 3/1971 | Hiester et al. | 342/8 |

(Continued)

FOREIGN PATENT DOCUMENTS

| | | |
|---|---|---|
| DE | 32 34 351 A1 | 5/1984 |
| DE | 89 00 340 U1 | 5/1989 |

(Continued)

OTHER PUBLICATIONS

Notification Concerning Transmittal of International Preliminary Report on Patentability (Forms PCT/IB/326 and PCT/IB/373) and the Written Opinion of the Searching Authority ( Form PCT/ISA/237) issued in the corresponding International Application No. PCT/GB2009/050507 dated Nov. 25, 2010.

(Continued)

*Primary Examiner* — Rob Swiatek
*Assistant Examiner* — Justin Benedik
(74) *Attorney, Agent, or Firm* — Buchanan Ingersoll & Rooney PC

(57) ABSTRACT

The present disclosure relates to a launch system for air vehicles. More specifically, the present disclosure relates to launching unmanned air vehicles (UAVs) that are unable to be launched by hand. The present disclosure provides a system for launching a winged vehicle, including: a projectile launching device; and a device for converting projectile momentum into acceleration of a winged vehicle.

18 Claims, 34 Drawing Sheets

(56) References Cited

U.S. PATENT DOCUMENTS

| | | | | | |
|---|---|---|---|---|---|
| 3,724,319 | A | * | 4/1973 | Zabelka et al. | 89/1.13 |
| 4,060,930 | A | * | 12/1977 | Hirtle et al. | 446/65 |
| 4,294,157 | A | * | 10/1981 | Stancil | 89/1.34 |
| 4,410,151 | A | | 10/1983 | Höppner et al. | |
| 4,666,105 | A | | 5/1987 | Dellinger et al. | |
| 4,683,797 | A | * | 8/1987 | Wittbrodt | 89/1.13 |
| 4,776,255 | A | * | 10/1988 | Smith | 89/1.13 |
| 5,060,413 | A | * | 10/1991 | Garcia | 43/19 |
| 5,392,755 | A | * | 2/1995 | Sutton | 124/5 |
| 5,417,139 | A | * | 5/1995 | Boggs et al. | 89/1.11 |
| 5,448,937 | A | * | 9/1995 | Buc et al. | 89/1.34 |
| 5,965,836 | A | * | 10/1999 | Rakov | 89/1.7 |
| 6,074,265 | A | * | 6/2000 | Barthold | 446/61 |
| 6,119,976 | A | | 9/2000 | Rogers | |
| 6,523,478 | B1 | | 2/2003 | Gonzalez et al. | |
| 6,679,155 | B1 | * | 1/2004 | Yaschur et al. | 89/1.813 |
| 7,210,654 | B1 | * | 5/2007 | Cox et al. | 244/63 |
| 7,318,565 | B2 | * | 1/2008 | Page | 244/63 |
| 2006/0226284 | A1 | * | 10/2006 | Poesch et al. | 244/63 |

FOREIGN PATENT DOCUMENTS

| | | | | | |
|---|---|---|---|---|---|
| FR | 2 871 388 | A1 | | 12/2005 | |
| FR | 2871388 | A1 | * | 12/2005 | A62B 37/00 |
| GB | 2 434 783 | A | | 8/2007 | |

OTHER PUBLICATIONS

International Search Report (PCT/ISA/210) dated Sep. 2, 2009.
European Search Report dated Jan. 23, 2009.
United Kingdom Search Report dated Sep. 23, 2008.

* cited by examiner

600

LAUNCH SYSTEM

The present invention relates to a launch system for air vehicles. More specifically, the present invention relates to launching unmanned air vehicles (UAVs) that are unable to be launched by hand or UAVs that either lack undercarriage or are unable to use undercarriage to take-off.

At present, there exist lightweight UAVs that weigh around 10 kg and which can be hand-launched by simply picking them up and throwing them. Realistically, it is only possible for vehicles significantly lighter than 10 kg to be hand-launched. If, however, the UAV is heavier than 10 kg, it becomes much more difficult to launch the vehicle. These vehicles can be powered by a range of propulsion means, such as a rear mounted propeller driven by a petrol, electric or diesel engine, or a jet engine or similar thrust-generating propulsion mechanism.

Currently, heavier UAVs are launched using a catapult device, but these catapults are cumbersome and generally unsuitable for use in fast moving situations: the catapult may need to be carried by a single person, as they are about 20 ft long, thus will be cumbersome to carry around due to their weight and dimensions being at the upper threshold of the capabilities of a single person; and the catapults are slow to set up due to their size, dimensions and weight.

Heavy and large UAVs are preferably provided with undercarriage to enable them to take-off and land on runways or landing strips, but this solution is generally reserved for more capable vehicles. Lower cost vehicles, less capable vehicles and smaller vehicles usually have to do without undercarriage and so an alternative launch means is required.

Accordingly, the present invention provides a mating component for engaging with a projectile wherein said mating component is configured to harness said projectile when said projectile is launched.

An advantage of using a mating component, for example the cap 90 described below, with a projectile launcher, for example a mortar launcher, to harness the energy of the projectile, for example a fin-stabilised mortar, is that the energy can be converted into acceleration for a vehicle such as a UAV as will be described below.

Specific embodiments of the invention will now be described, by way of example only and with reference to the accompanying drawings that have like reference numerals, wherein:—

Figure 35A:
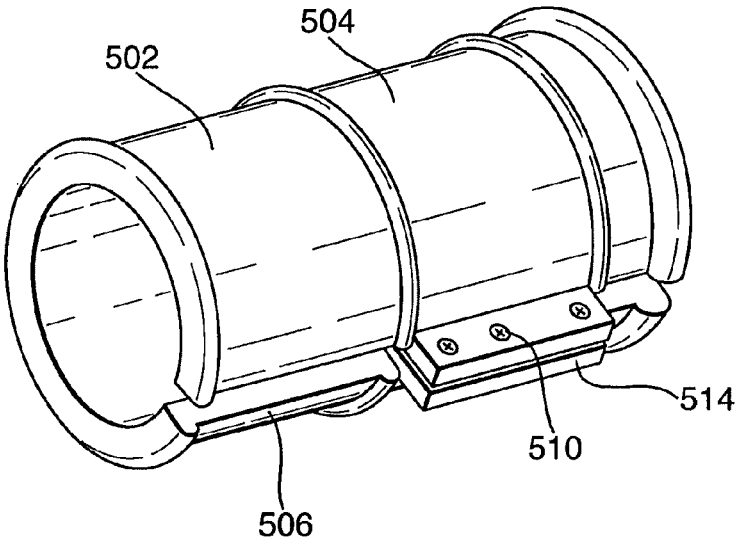
Figure 35B:
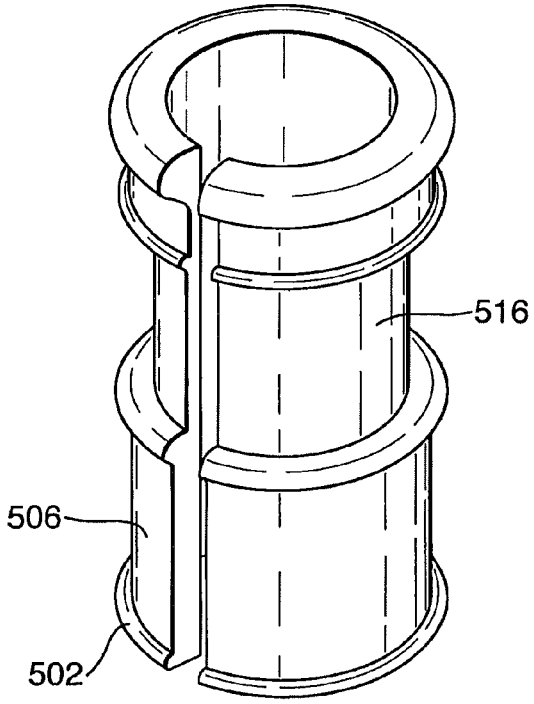
Figure 35C:
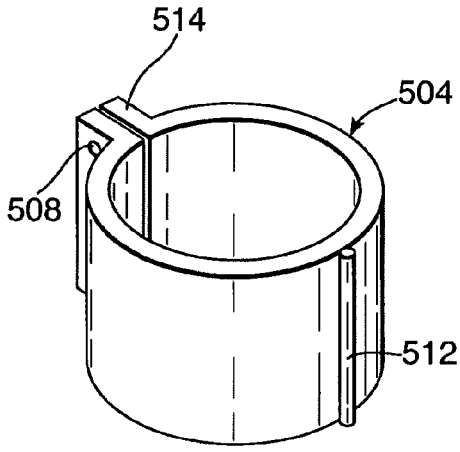
Figure 36:
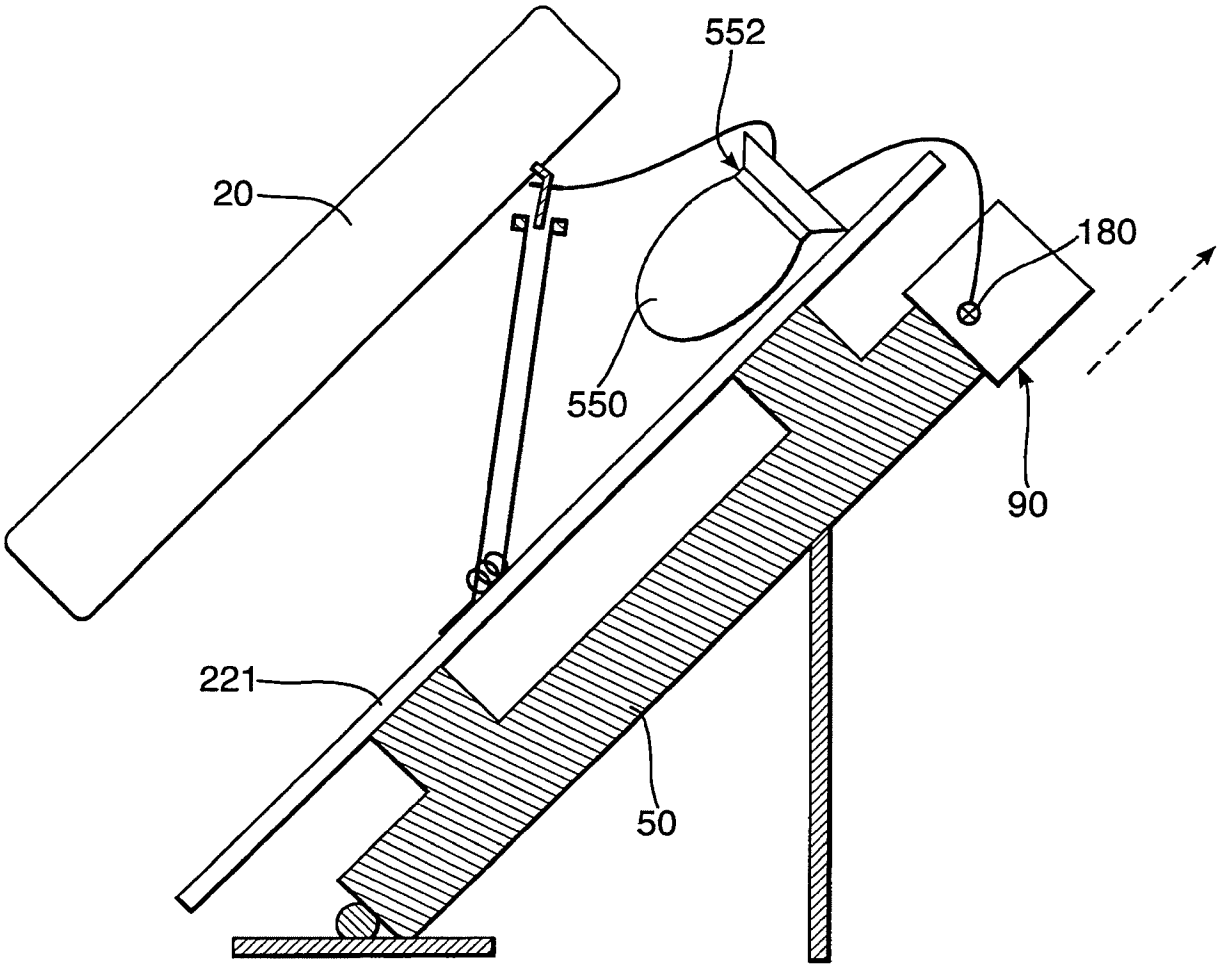
Figure 37:
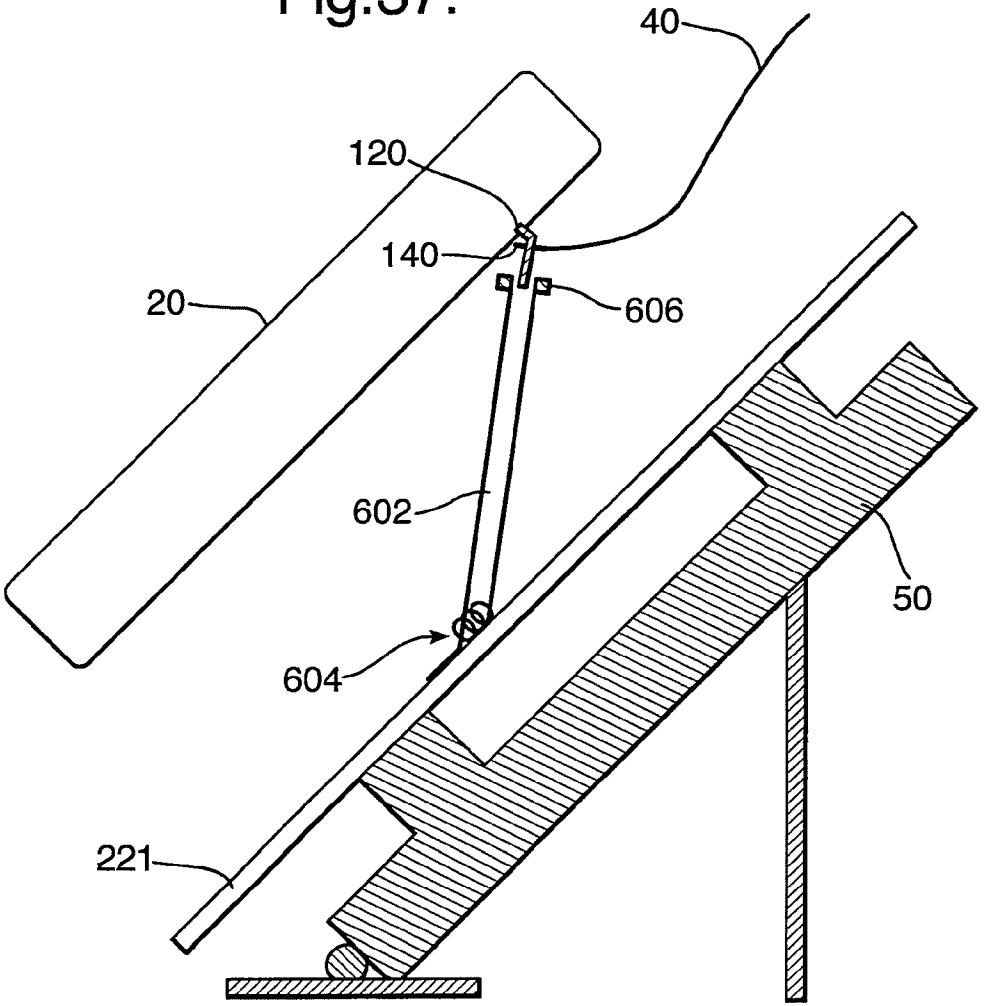

FIGS. 34*a*, 34*b*, 34*c* and 34*d* show an embodiment featuring a re-usable cap;

FIGS. 35*a*, 35*b* and 35*c* show an alternative embodiment featuring a re-usable cap;

FIG. 36 shows an embodiment incorporating an alternative dispensing mechanism for the shock cord; and FIG. 37 shows an alternative embodiment utilising a hook retention mechanism.

Figure 1:
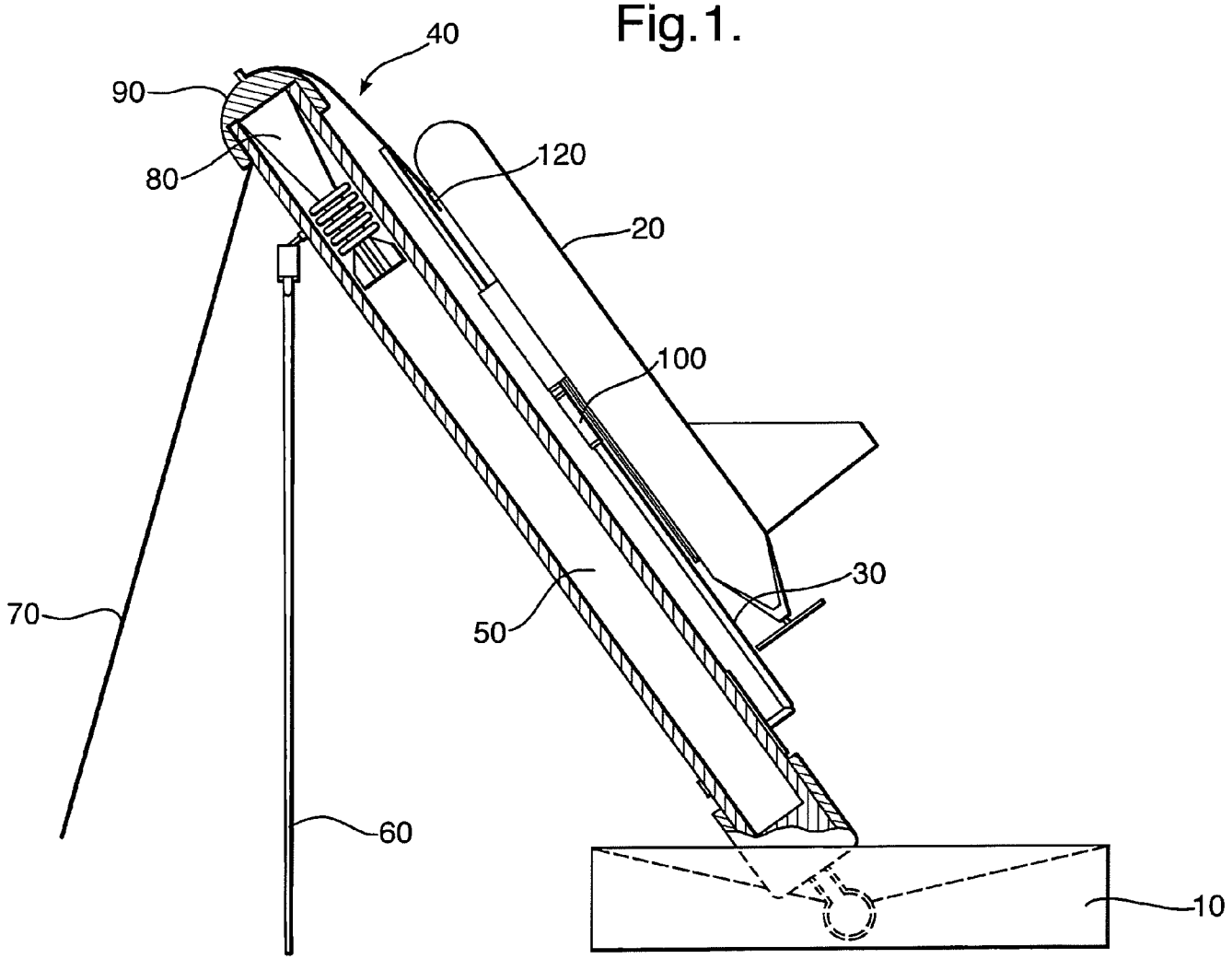
FIG. 1 is a cross-sectional diagram of an apparatus according to an embodiment of the present invention.

The general principles of the invention will now be described with reference to FIGS. 1 to 7 which show the launch process according to one embodiment of the invention:

Referring first to FIG. 1, there is shown a UAV 20 mounted on a mortar launch apparatus according to an embodiment of the invention in a pre-launch arrangement. In this embodiment, a standard 81 mm mortar launch tube 50 and an inert 81 mm fin-stabilised mortar round 80, having only a primary charge, are used.

The base 10 of the mortar launcher, to which one end, the fixed end, of the mortar launcher tube 50 is hingedly fixed, is put in position on the ground at the desired launch site. The fixed end is a closed end of the mortar launcher tube 50. The other end of the mortar launcher tube, the free end, is supported by a stand 60 that rests on the ground and thus supports the end of the tube 50. The free end of the mortar tube 50 is open, allowing an inert fin-stabilised mortar round 80 to be inserted into the tube 50 and to exit the tube 50 when launched.

In this embodiment the UAV 20 is mounted on takeoff runners 30 that are formed on top of the mortar launcher tube 50, mounted using a latch 100 that will only release the UAV 20 when it is moving in the correct direction, i.e. the direction of the mortar round 80 as it leaves the mortar tube 50, above a certain threshold of force. The latch 100 thus prevents the UAV 20 from sliding towards the ground or moving from position once it has been mounted on top of the mortar launcher tube 50 in readiness for launch. The latch 100 also prevents the UAV 20 sliding off the mortar launcher tube 50 too early when there isn't enough force from the shock cord to pull the UAV 20 clear of the mortar launcher tube 50.

It should be noted that alternative arrangements are possible for how the UAV 20 is mounted and secured on the mortar launcher tube 50 and these will be discussed below.

The engine of the UAV 20 is started before the mortar 80 is launched and once the UAV 20 is mounted and secured atop the mortar launcher 50, so that when the launch of the mortar round 80 is complete the UAV 20 can continue flying under its own propulsion, while the mortar round 80 will drop to the ground. In this embodiment, the UAV 20 has a rear-mounted propeller driven by a small petrol engine, though other types of UAV 20, having different means of propulsion, can be launched instead.

A mortar round 80 is placed into, but near the top of, the free end of the mortar launcher tube 50 by the operator and is fixed in place by the operator sliding a standard-issue slipper plate 110 on to the mortar round 80. The slipper plate 110 is a thin, flat metal plate with a portion cut away that allows it to fit around the mortar round 80 and into two grooves 130 on the sides of the mortar round 80. These grooves 130 can be seen in more detail in FIG. 25, which shows a cross-sectional diagram of the nose portion of a fin-stabilised mortar shell 80, showing the grooves 130 used to mate the mortar shell 80 to a slipper plate 110.

The slipper plate 110 is designed to be connected to a pull cord 70 with a pin so that an operator can pull the cord 70 such that the plate 110 slides out of the grooves in the mortar round 80, releasing the mortar round as discussed below in more detail. To this end, the slipper plate 110 is provided with a hole 111 to accept a pull cord 70, using a pin (not shown) to secure the pull cord 70.

Figure 25:
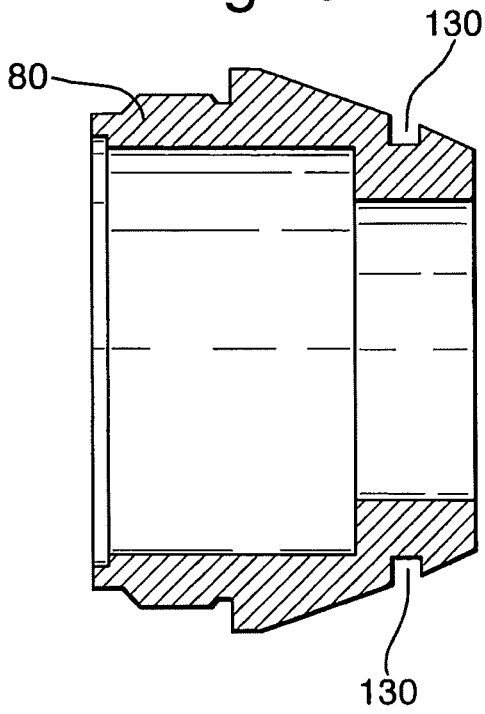
FIG. 25 is a cross-sectional diagram of the nose portion of a fin-stabilised mortar shell, showing the grooves used to mate the mortar shell to a slipper plate.
Figure 26:
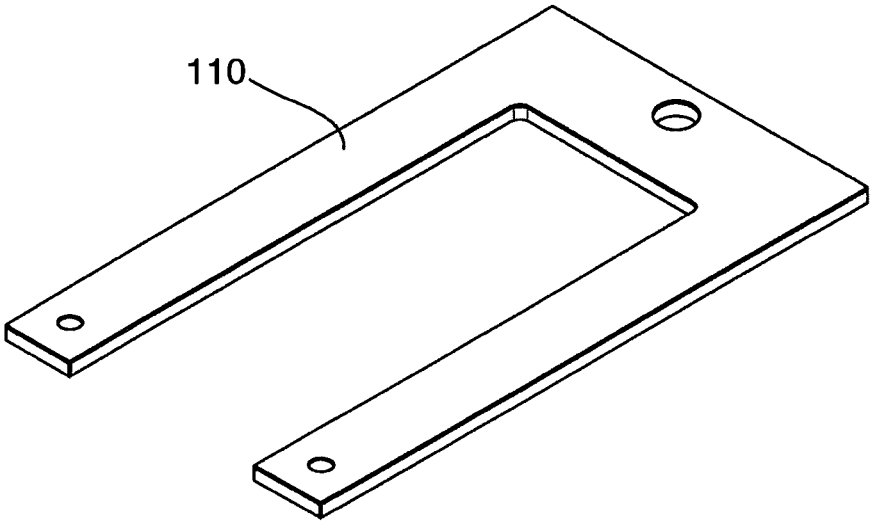
FIG. 26 is a perspective view of a slipper plate as used to mate with the notches in a nose portion of a fin-stabilised mortar shell of FIG. 25.

The slipper plate 110 is shown in more detail in FIG. 26 and can hold a mortar round 80 in place near the muzzle of the mortar launcher tube 50 because each mortar round 80 has two grooves 130, shown in FIG. 25, near the nose end of the mortar round 80 into which the edges of the slipper plate 110 insert, preventing the mortar round 80 moving further into the mortar launcher tube 50 as the slipper plate 110 is larger than the muzzle diameter of the mortar launcher tube 50.

A cap 90 is placed over the free end, or muzzle, of the mortar launcher tube 50 and the slipper plate 110. One end of a shock cord 40 is attached to the cap 90. The other end of the shock cord 40 is attached to a hook 120 underneath the nose of the UAV 20.

Figure 9:
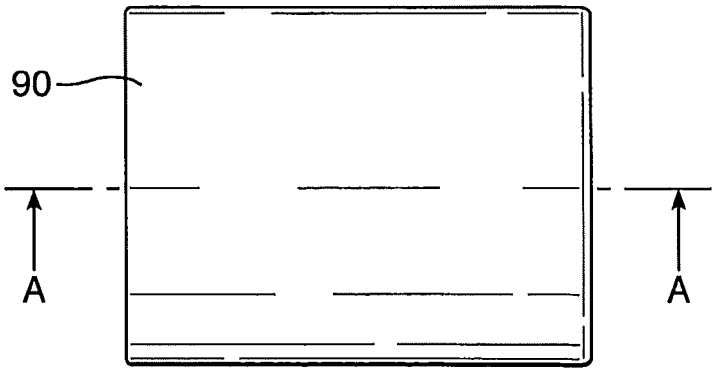
FIG. 9 is a diagram of the cap of FIG. 8 from a different perspective with a section line A-A.
Figure 10:
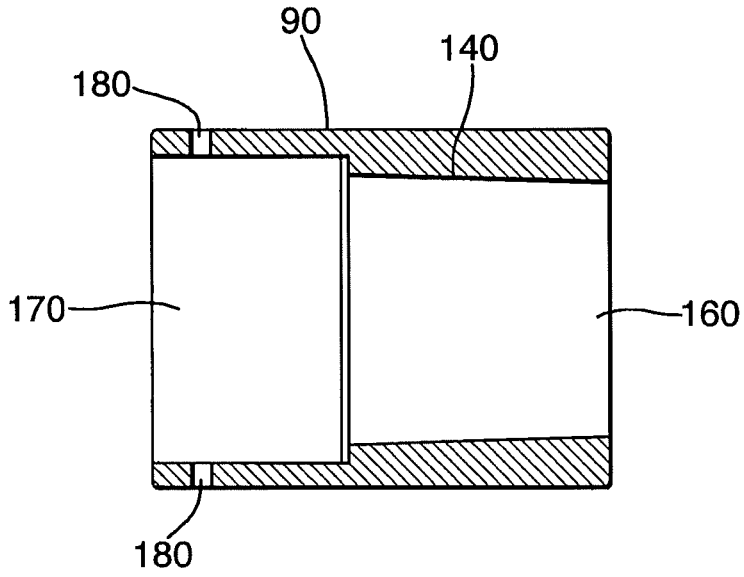
FIG. 10 is a cross-sectional diagram of the cap of FIG. 8 along the section line A-A of FIG. 9.
Figure 11:
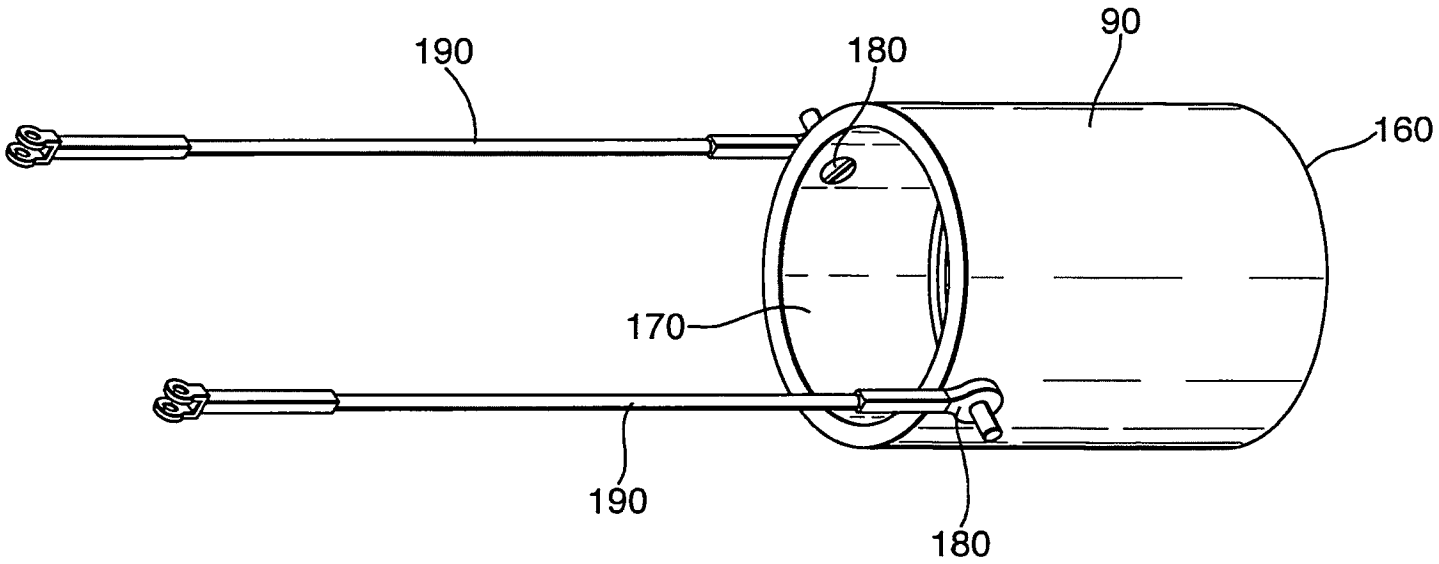
FIG. 11 is a perspective view of a cap of FIG. 8 connected to two metal wires, to which shock cords can be connected at the free ends of the wires.
Figure 12:
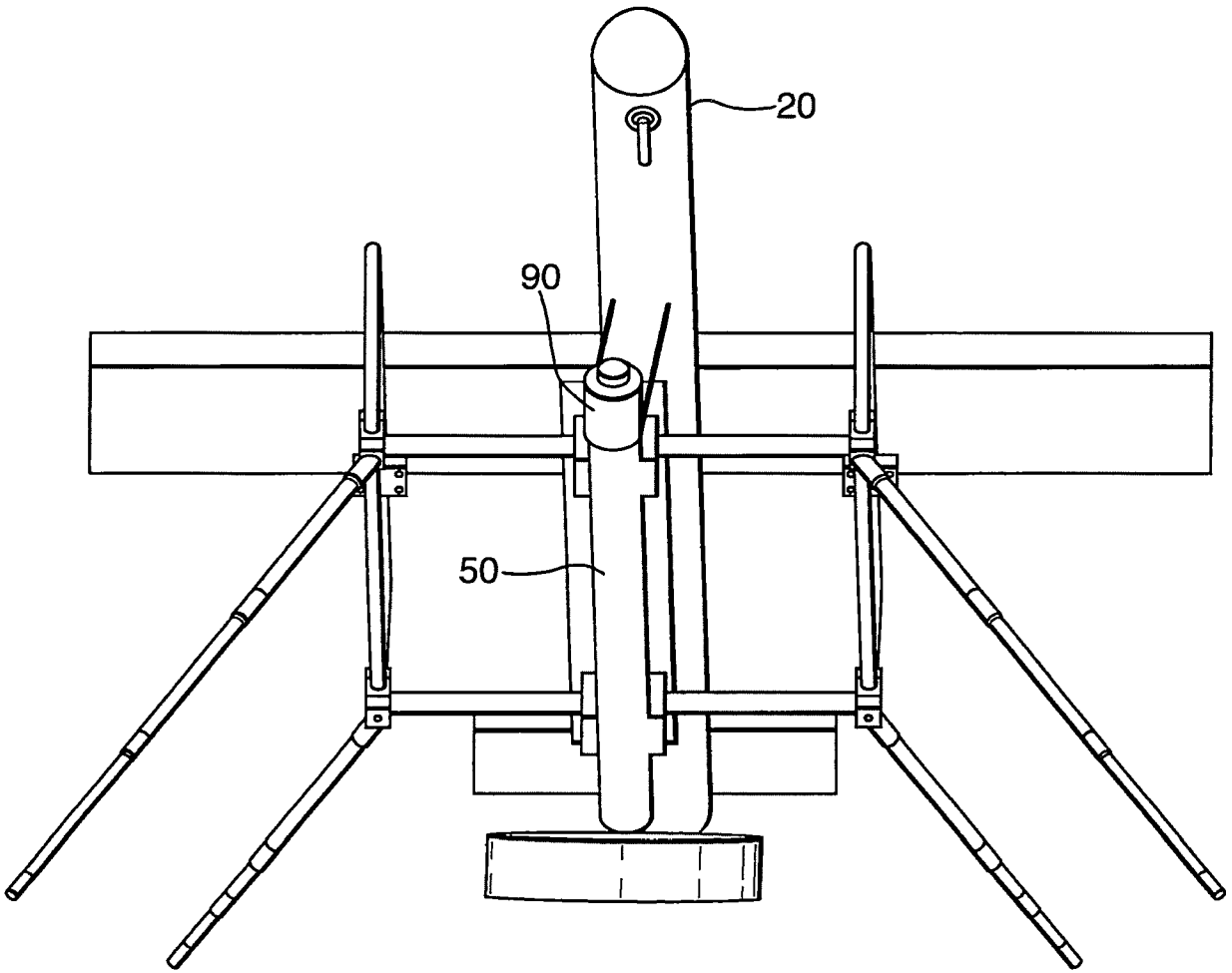
FIG. 12 is a diagram of a UAV mounted on a support frame over a mortar launcher according to a preferred embodiment of the invention.
Figure 13:
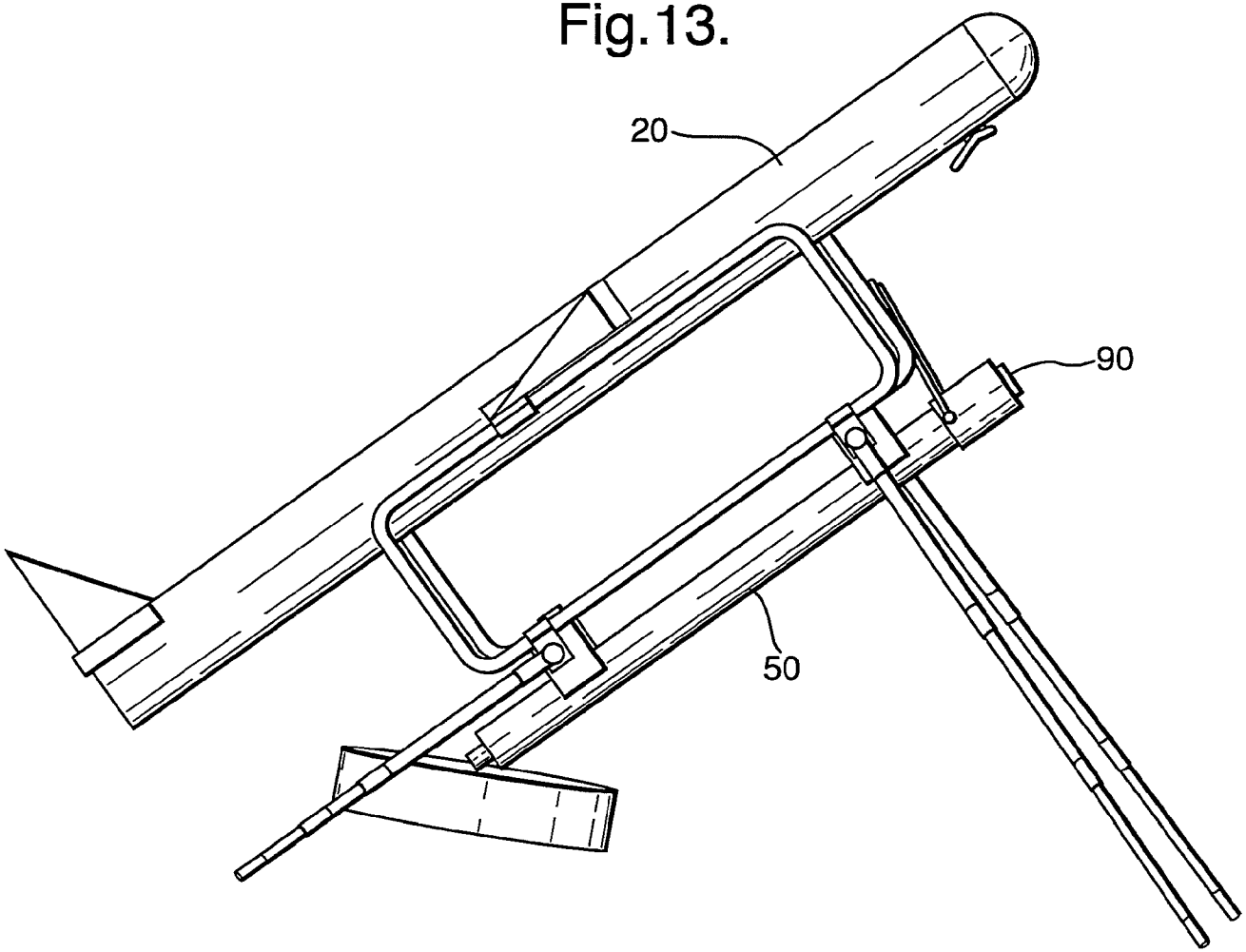
FIG. 13 is a diagram of a UAV mounted on a support frame over a mortar launcher according to a preferred embodiment of the invention.
Figure 14:
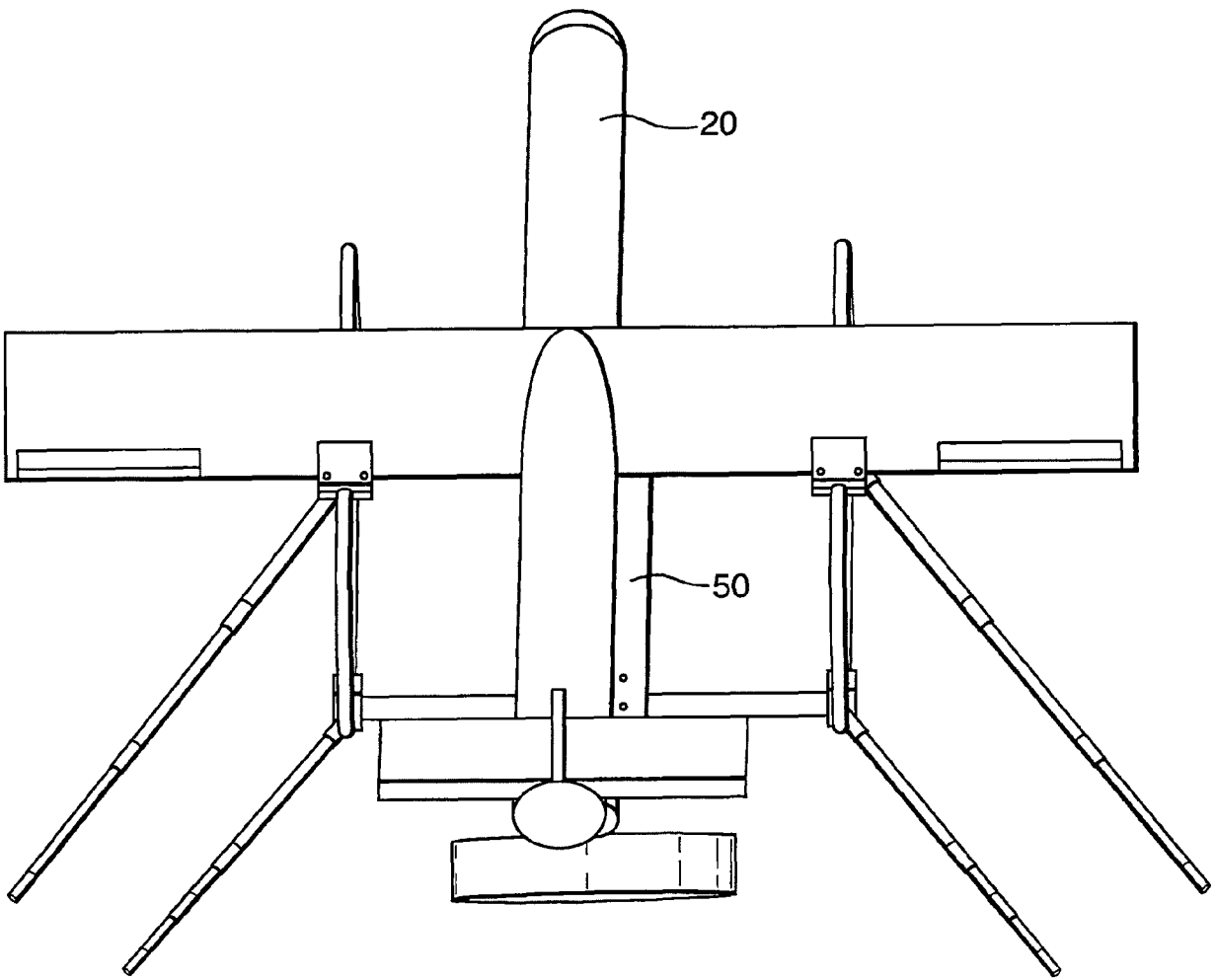
FIG. 14 is a diagram of a UAV mounted on a support frame over a mortar launcher according to a preferred embodiment of the invention.
Figure 15:
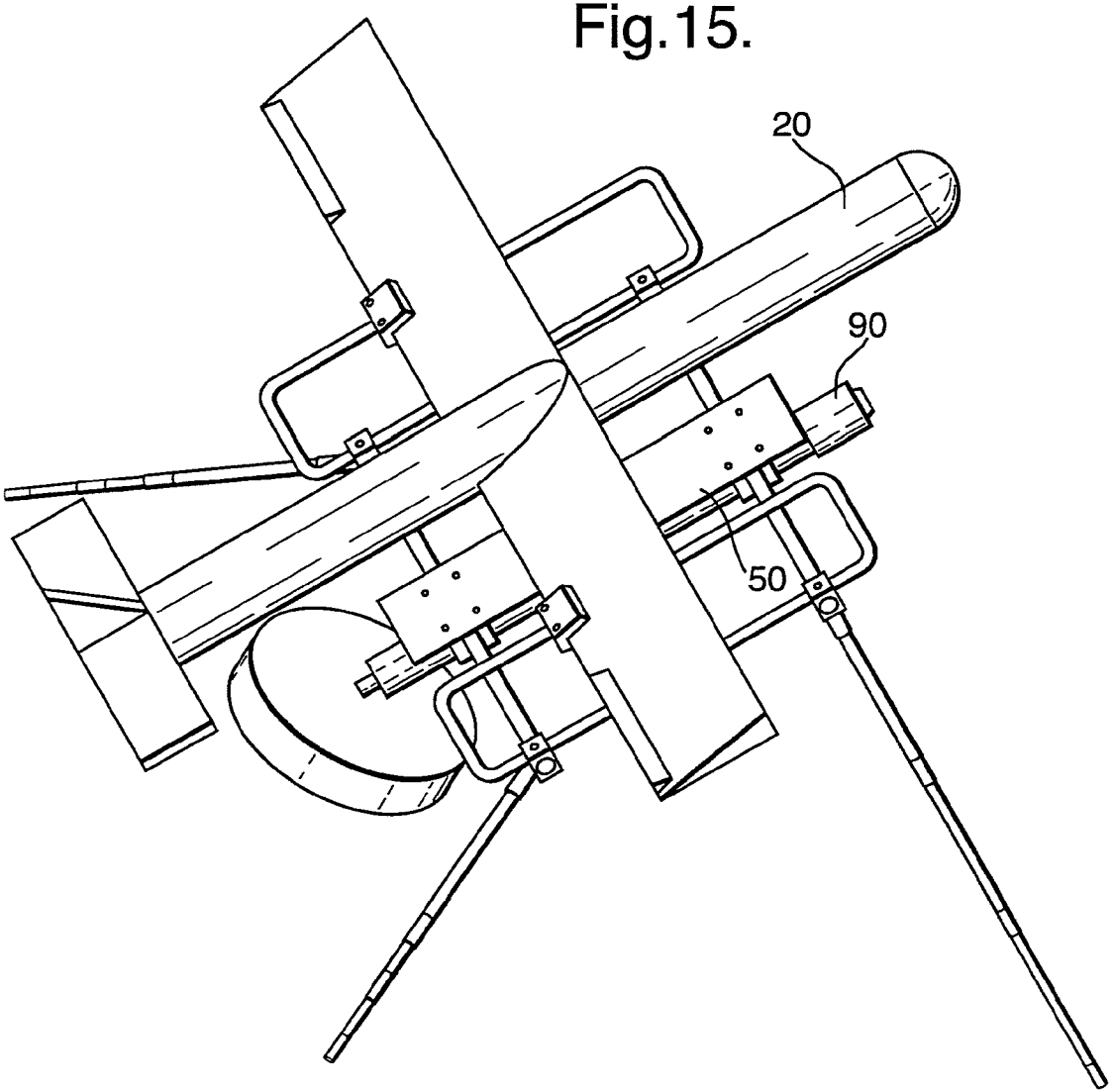
FIG. 15 is a diagram of a UAV mounted on a support frame over a mortar launcher according to a preferred embodiment of the invention.
Figure 16:
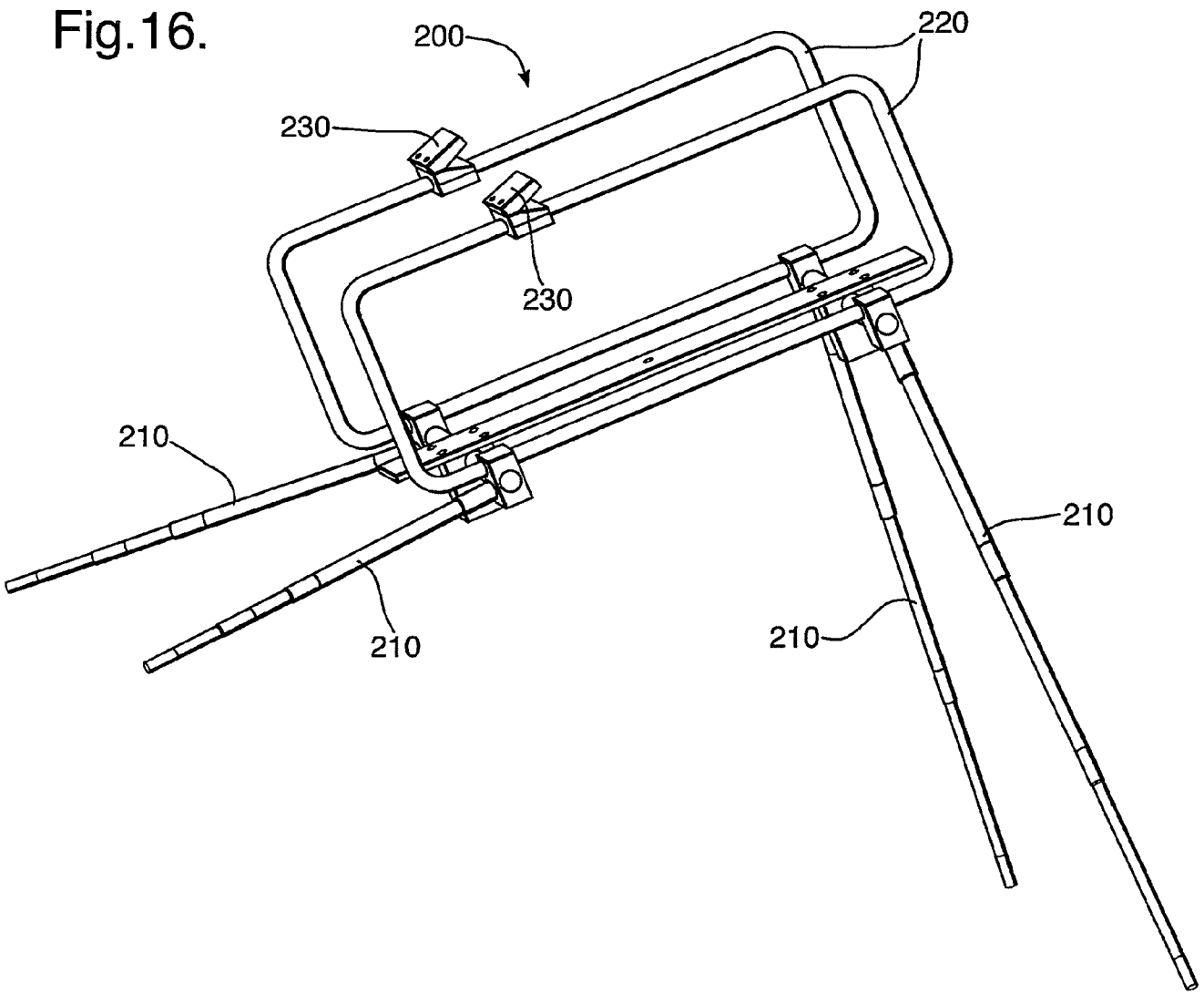
FIG. 16 is a diagram of the support frame of FIGS. 12 to 15 according to a preferred embodiment of the invention.
Figure 17:
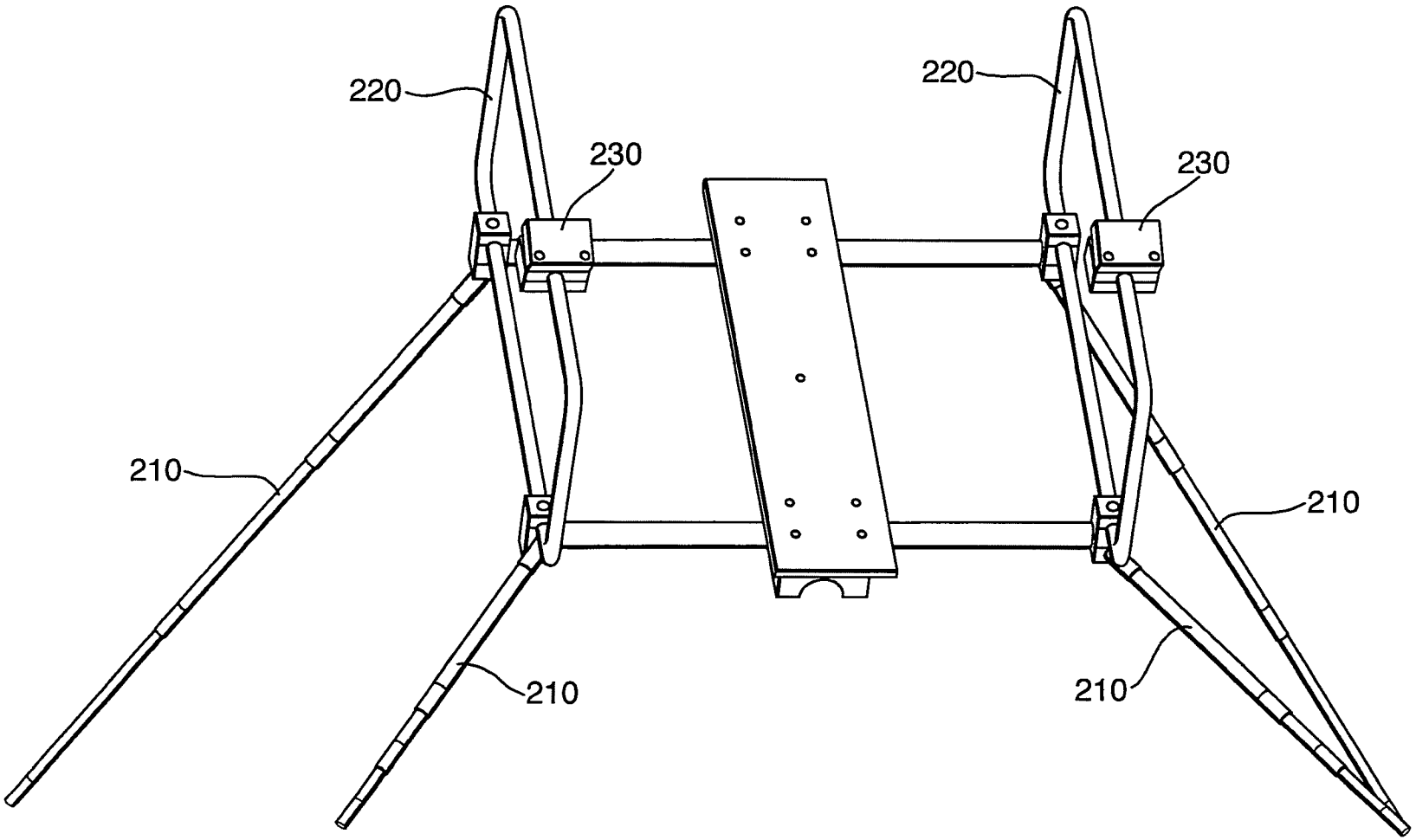
FIG. 17 is a diagram of the support frame of FIGS. 12 to 15 according to a preferred embodiment of the invention.
Figure 18:
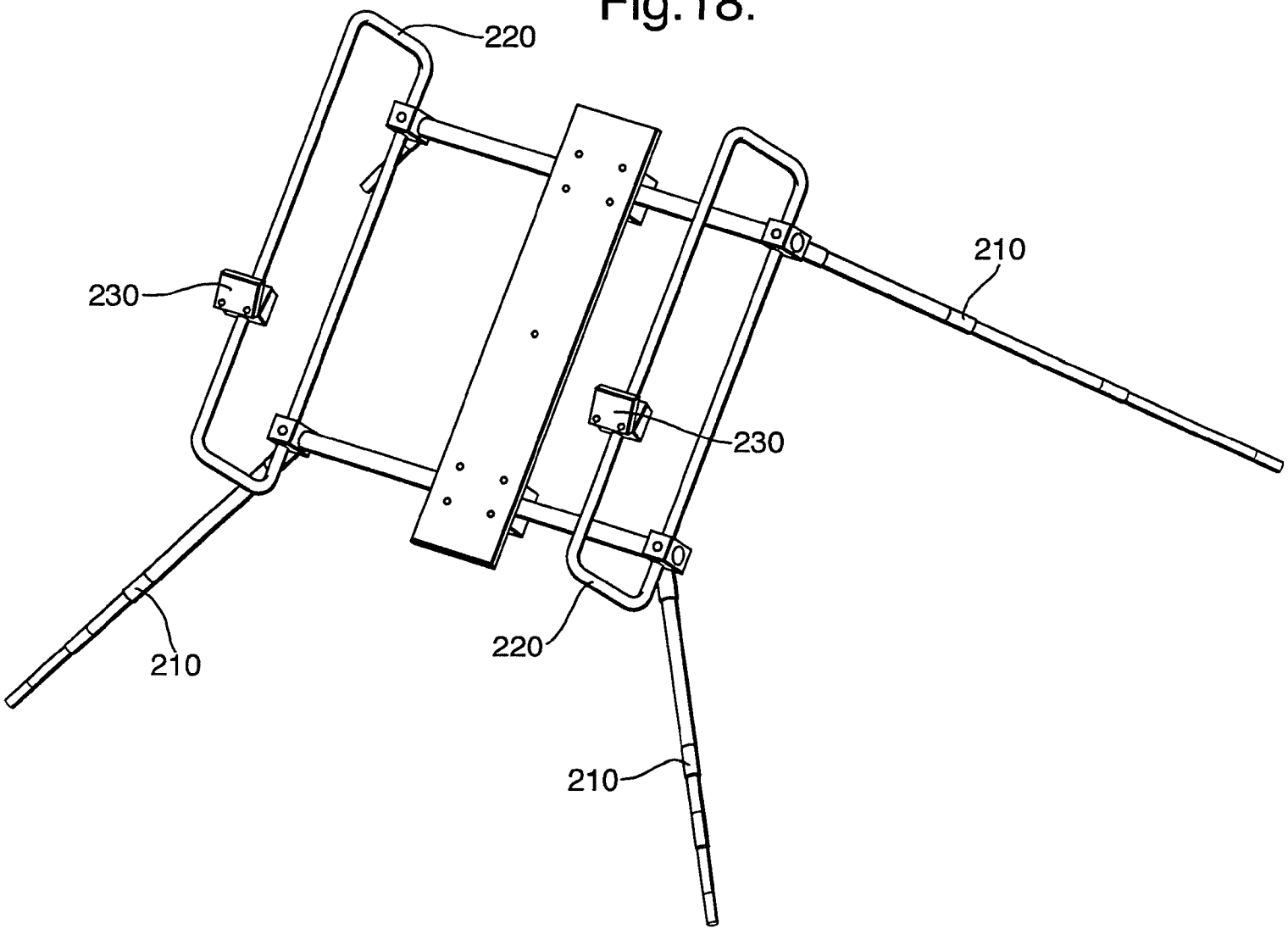
FIG. 18 is a diagram of the support frame of FIGS. 12 to 15 according to a preferred embodiment of the invention.
Figure 19:
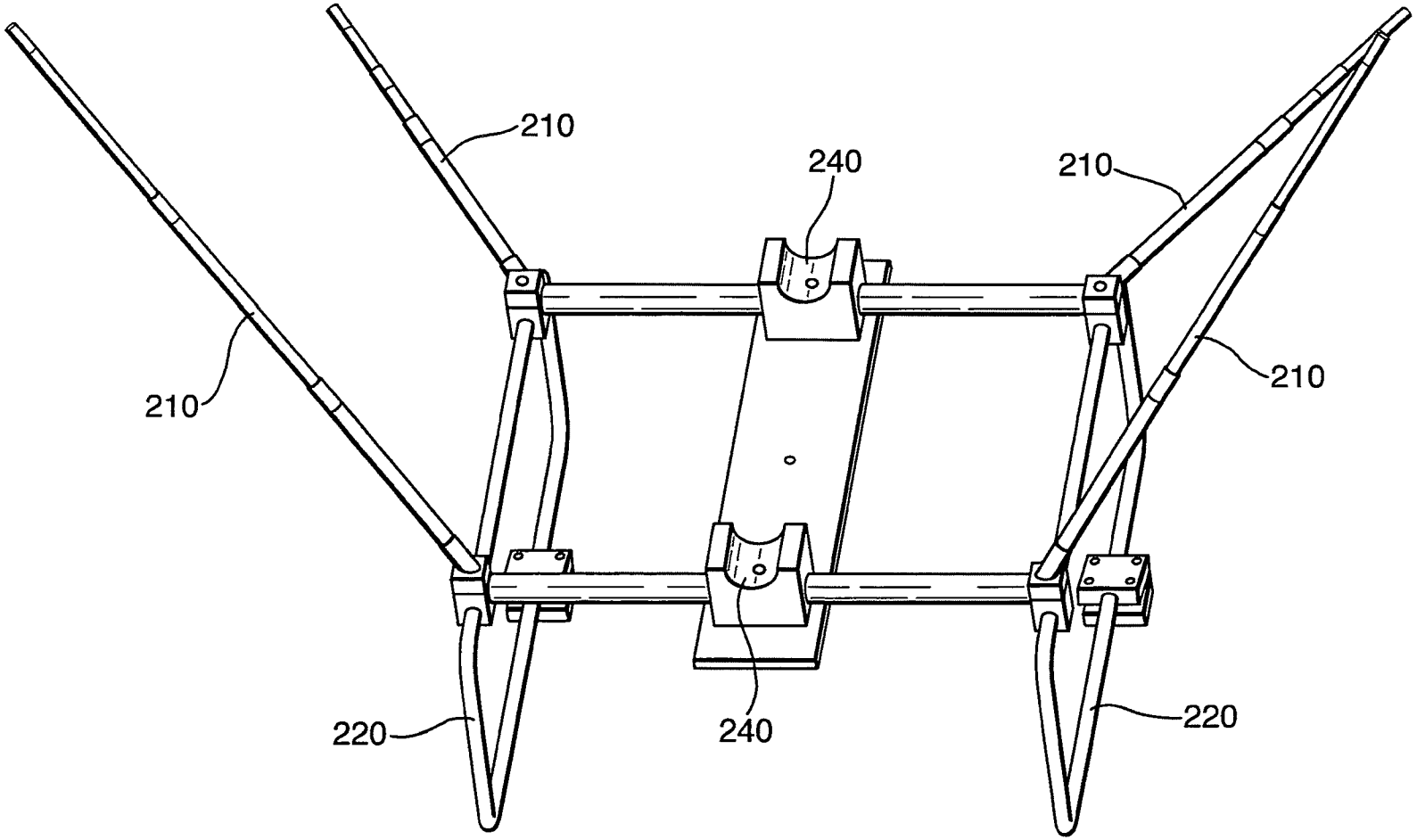
FIG. 19 is a diagram of the support frame of FIGS. 12 to 15 according to a preferred embodiment of the invention.

In one embodiment of the invention, the slipper plate 110 fits on top of the cap, rather than on between the cap 90 and the muzzle of the mortar launch tube 50. The cap 90 is fitted onto the free end of the mortar launch tube and is formed (as shown in FIGS. 9, 10 and 11 and in particular in FIG. 10) with a stepped inner diameter, with the larger diameter operable to fit around the muzzle of a mortar launch tube 50.

To allow the slipper plate 110 to easily and quickly fit on top of the cap 90 in operation, the mortar round 80 can be fitted loosely into the cap 90 before insertion into the top of the mortar launch tube 50. The slipper plate 110 is then secured in place so that the tip of the mortar round 80 extends out of the top of the cap 90 to allow the slipper plate 110 to fit into the grooves 130 in the mortar round 80. This allows the mortar 80 to fall to the bottom of the mortar launch tube 50 when the slipper plate 130 is removed, as the mortar round 80 does not form a secure interference fit with the cap 90 when only inserted far enough to allow the slipper plate 110 to fit into the grooves 130 in the mortar round 80. This configuration enables the operator to place the pre-prepared combination of mortar shell 80, slipper plate 110 and cap 90 on to the mortar launch tube in one operation.

Figure 2:
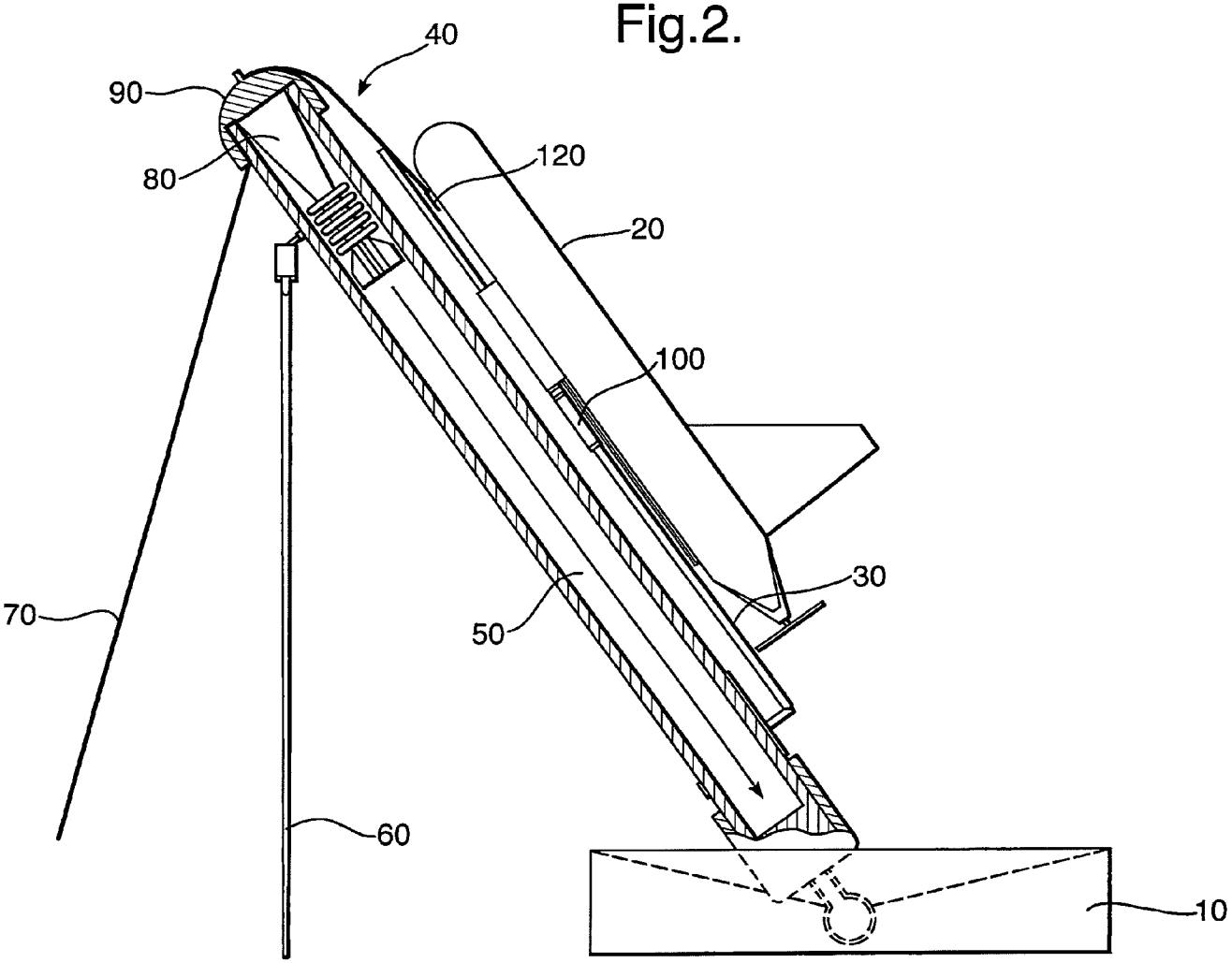
FIG. 2 is a cross-sectional diagram of an apparatus according to an embodiment of the present invention showing the first step of operation.

Referring now to FIG. 2, there is shown the apparatus of FIG. 1 but now during the first step of operation. The safety cord 70 is pulled by the operator, pulling the slipper plate 110 out of the grooves 130 that hold the mortar round 80 in place at the muzzle of the tube 50, causing the mortar round 80 to drop down the mortar launch tube 50 to the bottom of the mortar launch tube 50 from the top of the mortar launch tube 50.

Figure 3:
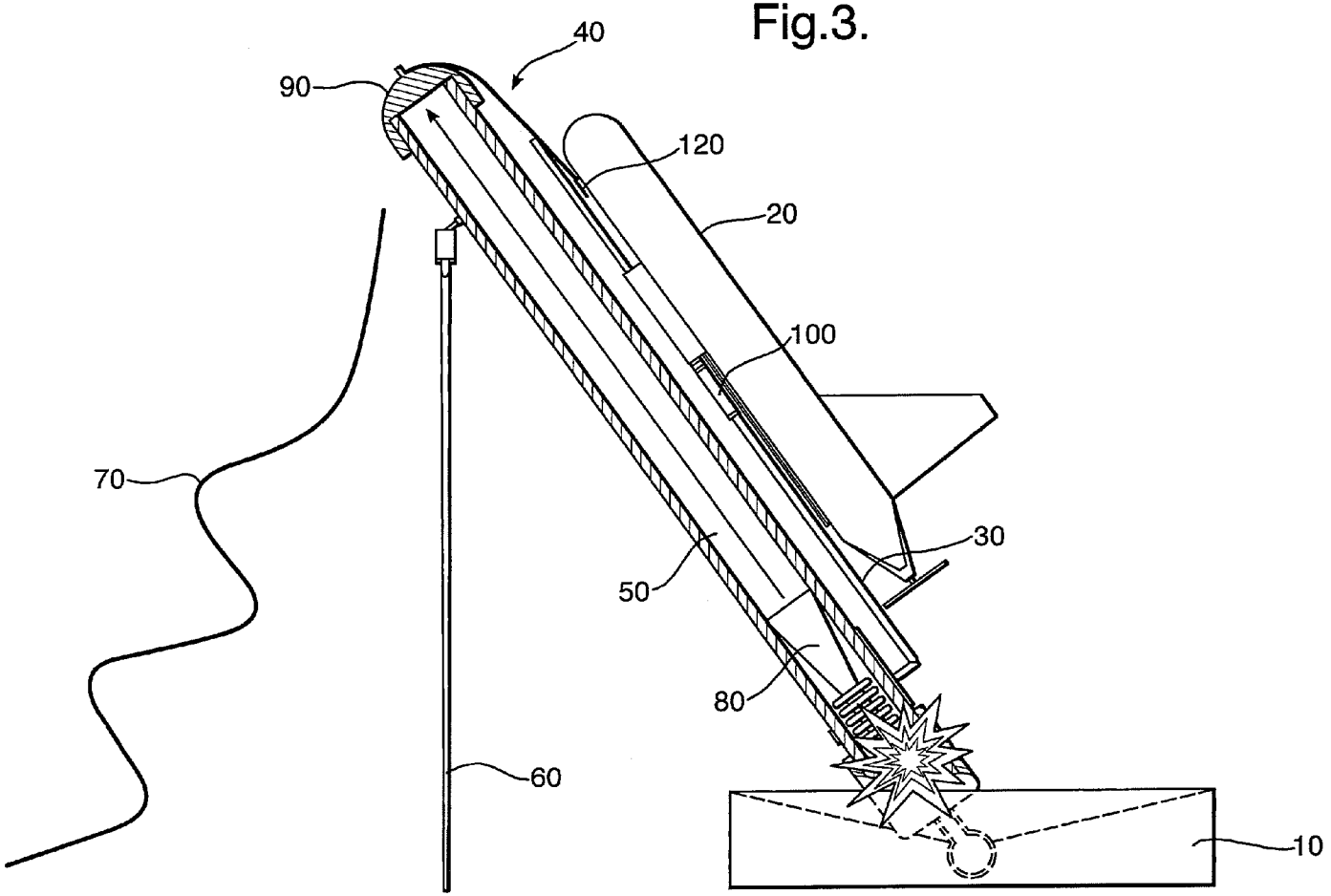
FIG. 3 is a cross-sectional diagram of an apparatus according to an embodiment of the present invention showing the second step of operation.

Referring now to FIG. 3, there is shown the apparatus of FIG. 1 during the second step of operation. The firing pin of the mortar charge 80 is triggered when it hits the bottom of the mortar launch tube 50, initiating the propellant and thus the mortar round 80 rapidly accelerates up the mortar launch tube 50.

Figure 4:
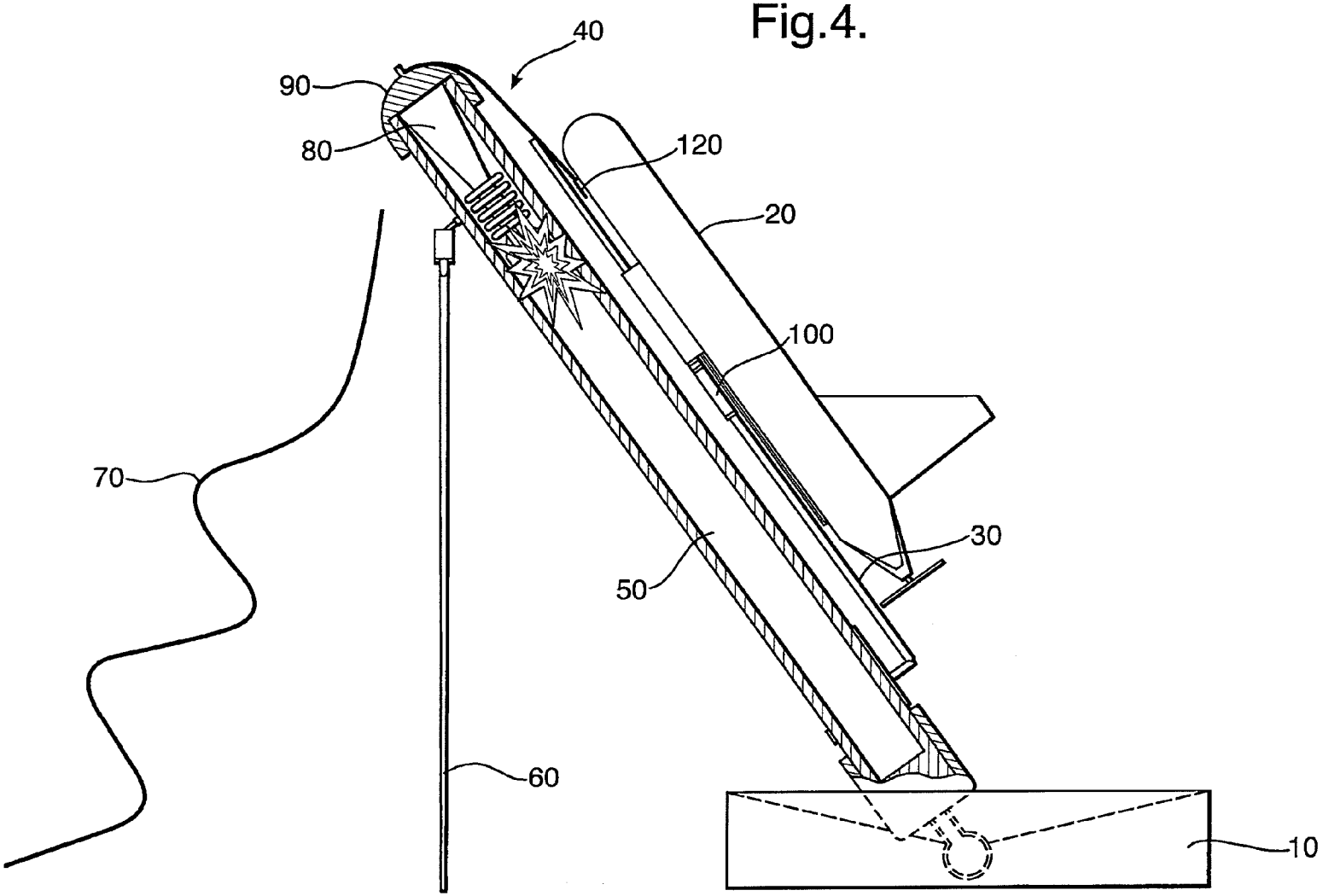
FIG. 4 is a cross-sectional diagram of an apparatus according to an embodiment of the present invention showing the third step of operation.

Referring now to FIG. 4, there is shown the apparatus of FIG. 1 during the third step of operation. The mortar round 80 hits the cap 90, engaging and mating with a contacting face 140 of the cap 90 by an interference fit, the cap 90 being designed to mate with the nose of the mortar round 80 by having a taper of 1 in 48. Several alternative caps are possible, and some are described below.

Figure 5:
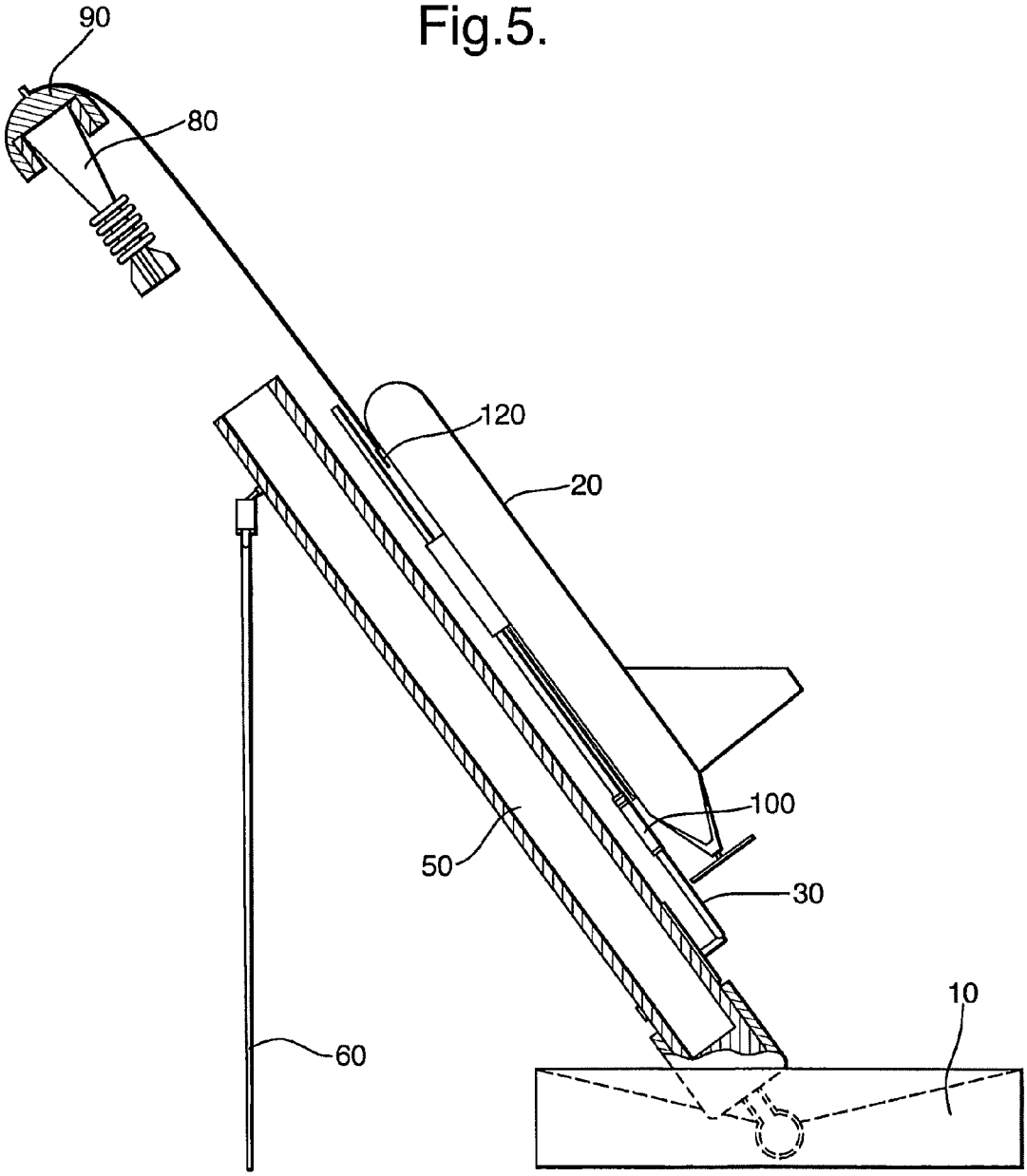
FIG. 5 is a cross-sectional diagram of an apparatus according to an embodiment of the present invention showing the fourth step of operation.

Referring now to FIG. 5, there is shown the apparatus of FIG. 1 during the fourth step of operation. The mortar round 80 continues out of the mortar launch tube 50 along with the cap 90, the mortar round 80 having mated with the cap 90. Thus, the cap 90 harnesses the energy and acceleration of the mortar round 80. As cap 90 is also connected to one end of the shock cord 40, the other end of the shock cord 40 being fixed to the nose of the UAV 20, the shock cord 40 absorbs the initial shock of the mortar launch and starts to stretch between the stationary UAV 20 and the moving mortar round 80. Once the tension in the shock cord 40 is sufficient, the shock cord 40 also harnesses the energy of the mortar round 80 and starts to pull the UAV 20 in the direction of travel of the mortar 80 and cap 90, causing it to gradually accelerate rather than accelerating at the same high acceleration as the mortar round 80. In this way the energy of the mortar round 80 is captured (or harnessed) by the cap 90 and in turn by the UAV 20 via the shock cord 40.

Figure 6:
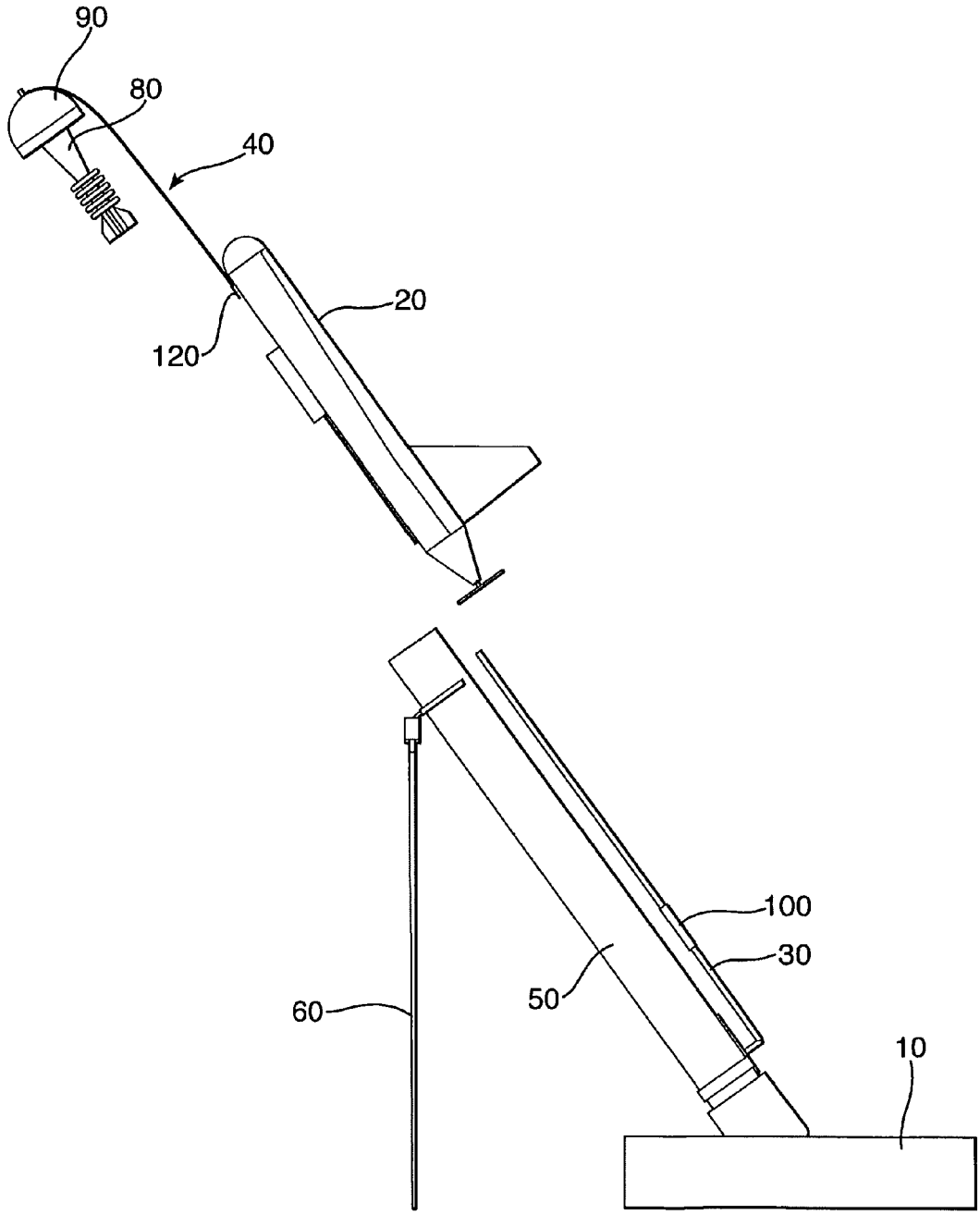
FIG. 6 is a diagram of an apparatus according to an embodiment of the present invention showing the fifth step of operation.

Referring now to FIG. 6, there is shown the apparatus of FIG. 1 during the fifth step of operation. Here, the shock cord 40 has been stretched as far as the respective forces will allow, so the latch 100 releases UAV 20 as enough force will now be pulling the UAV 20 to allow it to take off. The UAV 20 leaves the takeoff runners 30 with a suitably high acceleration to take off but not with too high an acceleration to cause damage to the UAV 20. As mentioned above, the latch 100 only releases the UAV 20 once a predetermined force threshold has been exceeded.

It should be noted that no latch 100 is needed, but some mechanism is needed to hold the UAV 20 in place when it is mounted over the mortar launcher tube 50 whilst allowing it to accelerate in the direction of the mortar shell 80 when the mortar shell 80 is launched.

Figure 7:
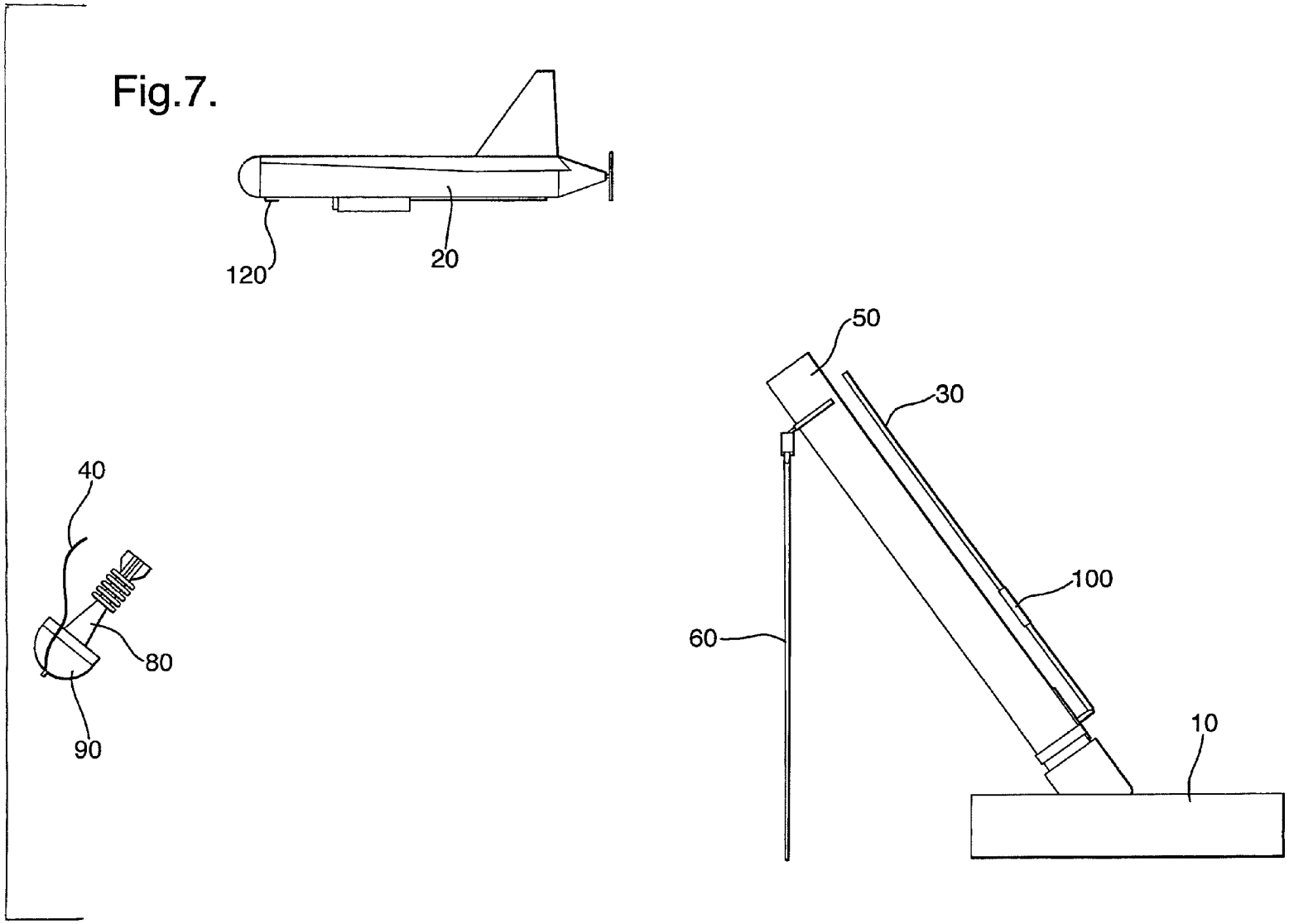
FIG. 7 is a diagram of an apparatus according to an embodiment of the present invention showing the final step of operation.
Figure 28:
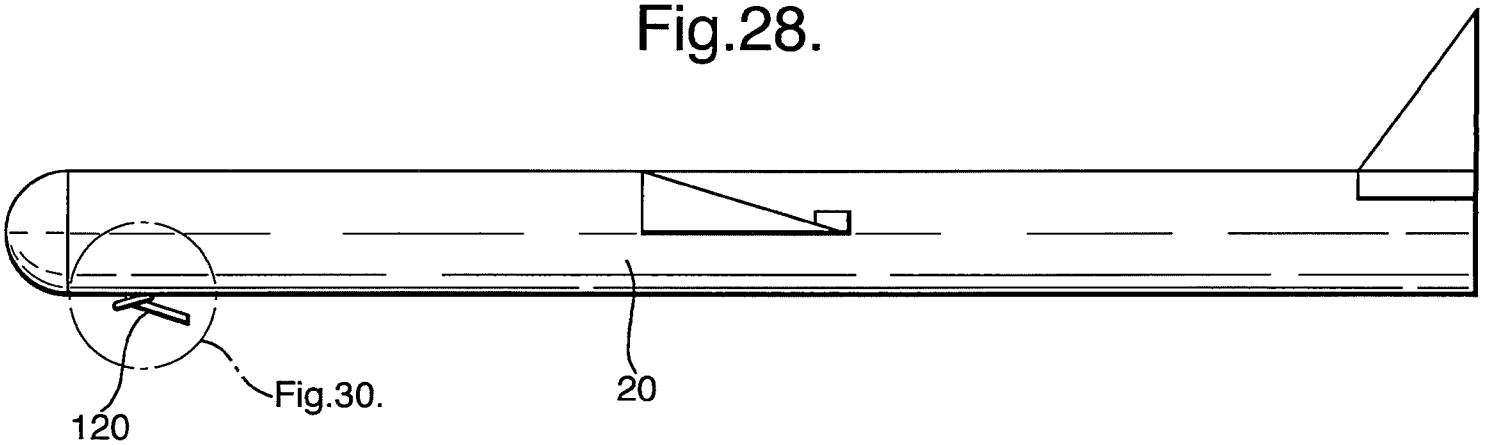
FIG. 28 is a diagram of a UAV with a hook mounted under the nose portion for attaching to a shock cord.
Figure 29:
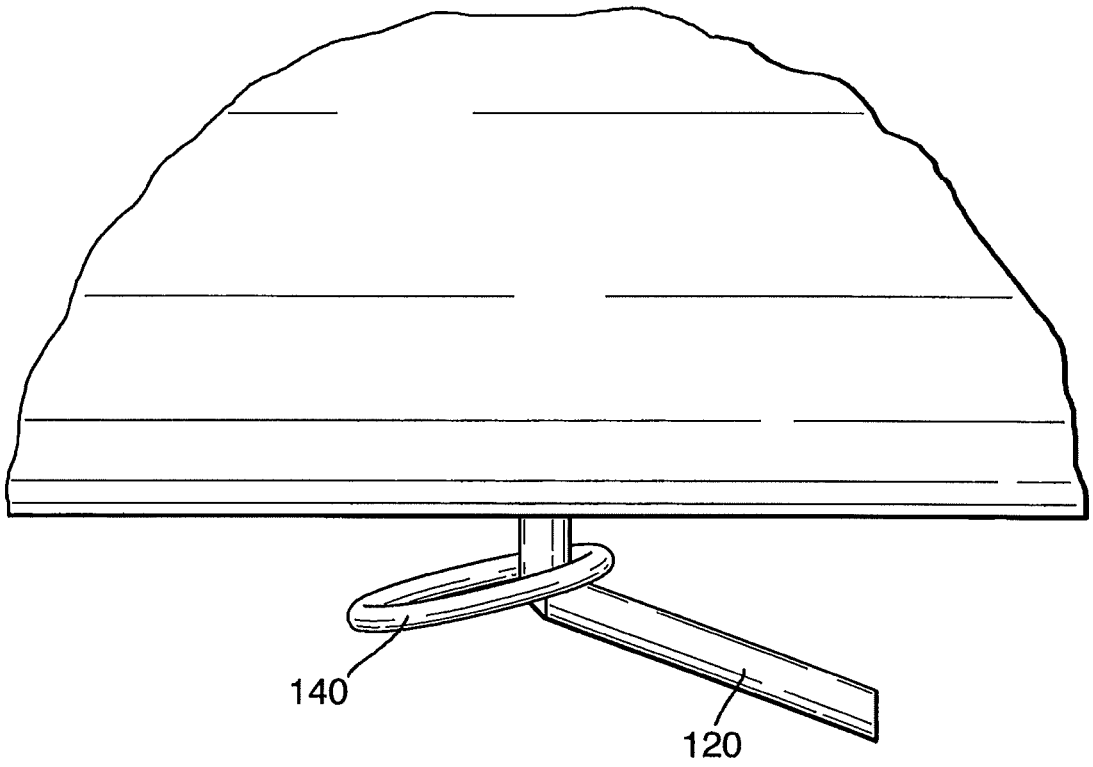
FIG. 29 is a diagram of the hook of FIG. 28, also showing a ring to which a shock cord would be attached.

Referring now to FIG. 7, there is shown the apparatus of FIG. 1 during the final step of operation. Here, the UAV 20 is travelling under its own propulsion, as it is airborne and at a suitable speed to continue flying, while the mortar shell 80 is losing momentum, so the UAV 20 overtakes the mortar shell 80 and cap 90, causing the shock cord 40 to come loose around 0.5 seconds after firing the mortar shell 80. At this point, the shock cord 40, cap 90 and mortar shell 80 start to fall back to earth. The hook 120 to which the shock cord 40 is connected only allows the mortar round 80 to pull the UAV 20, but not to cause drag, so once the mortar is no longer pulling the UAV 20 forwards, the ring 150 to which the shock cord is disconnected (see FIGS. 28 and 29). The hook 120 is purely a hook pointing backwards to the direction of travel, so when the force exerted by the shock cord drops off, the ring 140 simply slides off the hook 120 as the UAV 20 overtakes or starts to overtake the shock cord 40, mortar round 80 and cap 90. This allows the UAV 20 to fly away separately from the shock cord 40.

Figure 8:
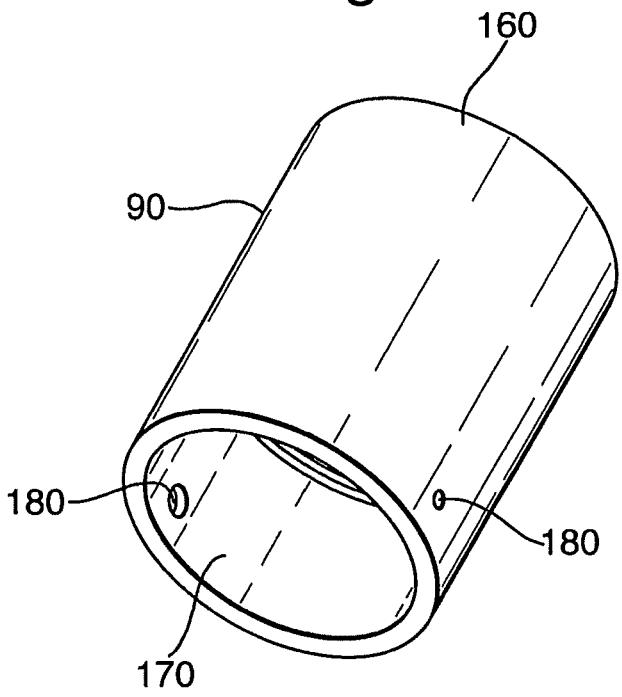
FIG. 8 is a diagram of a cap according to a preferred embodiment of the present invention.

In FIGS. 8, 9 and 10 a preferred embodiment of the cap 90 is shown in more detail: the cap 90 is formed as a cylinder and has a hollow interior. The cap 90 has an opening 160 at the top and an opening 170 at the bottom. There are two holes 180 formed opposite each other in the sides of the cap 90 near the bottom opening 170 to allow the two shock cords 40 to be mounted, and these holes 180 are countersunk on the inside face of the cap 90 to prevent the bolts, which hold the shock cords 40 to the cap, obstructing the path of the mortar round 80.

The inside, contacting, face 140 of the cap 90 decreases in diameter from one open end 170 to the other open end 160, from bottom end to top end, so that the mortar round 80 mates with the cap 90 when it is launched as it becomes lodged in the cap 90 when the diameter of the cap 90 decreases to the substantially the diameter of the widest diameter of the mortar shell 80, i.e. using an interference fit.

The cap 90 with the 81 mm mortar shell 80 in a preferred embodiment is designed to from a 1 in 48 taper interference fit. It is possible to use other tapers but it should be noted that the cap 90 must have to have a sufficient taper to capture the mortar shell 80.

It is possible to choose a taper that allows the head of the mortar shell 80 to pass through the cap 90 and for the mortar fins to be captured in the cap 90, and this effect is known as "fin grab". It is noted that in some instances fin grab might be preferable as gives a smoother flight but also opens up the possibility of the cap 90 not capturing the mortar round 80.

In this embodiment, aircraft grade L168 aluminium alloy is preferably used to manufacture the cap 90 but it is conceivable that other alloys could be used instead.

Figure 27:
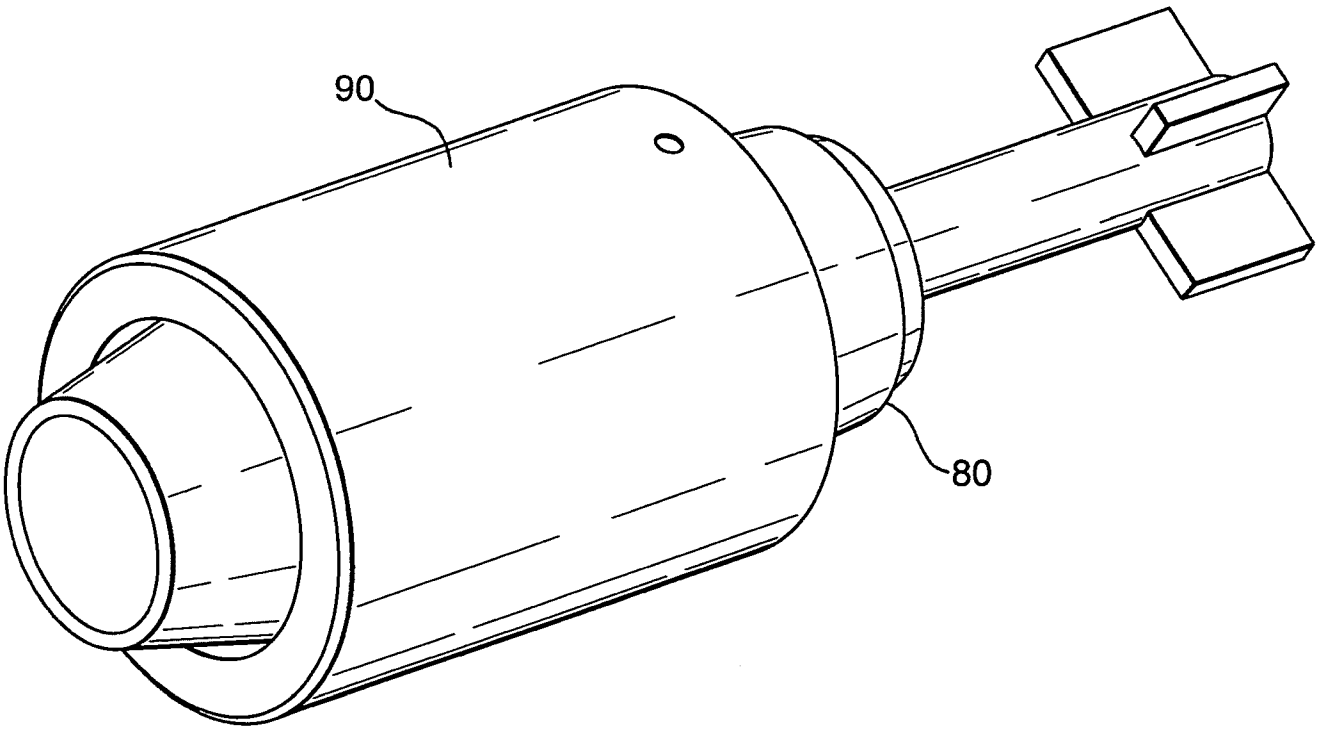
FIG. 27 is a perspective view of a fin-stabilised mortar when mated with the cap of FIGS. 8 to 10.

FIG. 27 shows a fin-stabilised mortar 80 as would be suitable for use with the invention once mated with the cap 90.

The shock cord used has a 7.5 m length and has an 11 mm diameter, once the shock cord is doubled up to enable the ends to form loops. A single 15 m length shock cord 40 is used with the doubled-up end formed into a loop and connected to the UAV 20 using a metal ring and the two loose ends formed into loops and connected to the cap 90. The doubled up shock cord 40 is taped at regular intervals along its 7.5 m length using a thread based tape to prevent the shock cord configuration from becoming distorted. Alternatively, a shrink wrap could be used at regular intervals to hold the shock cord in the doubled up configuration. This specification and configuration for the shock cord enables it to be used at a suitable range of weights of UAV 20. The ends of the shock cord and the doubled up middle portion of the shock cord utilise a well known twine wrap method, wherein twine is wrapped around the two cords to secure them together to form loops to enable connection to the cap 90 or to the metal rods or wire 190.

In a preferred embodiment, as shown in FIG. 11, the shock cords are not attached directly to the holes using bolts, as the fin of the mortar round can wear away the shock cords 40. Instead, metal rods or wire 190 are bolted to the holes 180 in cap 90 and the shock cords are connected to the ends of these rods/wires 190. This removes the elastic effect at the UAV connection and allows the shock cord to be distanced from the fins of the mortar round 80, which might damage the shock cord. The metal rods or wire 190 are preferably boden cables or some other form of reinforced crimp-fitted cable.

A pin with a lock ring is used to connect the looped shock cord ends 40 to the metal rods or wire 190. Alternatively, a bolt and washer can be used to connect the looped shock cord ends 40 to the metal rods or wire 190.

In another embodiment, two shock cords 40 can be used. In a preferred embodiment, two looped shock cords ends are used to connect to opposite sides of the cap 90, preferably connecting the shock cord ends 40 to the metal rods or wire 190 which are in turn connected to the cap 90, to stabilise the trajectory of the mortar once it mates with the cap 90, and this also substantially prevents the cap 90 rotating in flight.

Figure 20:
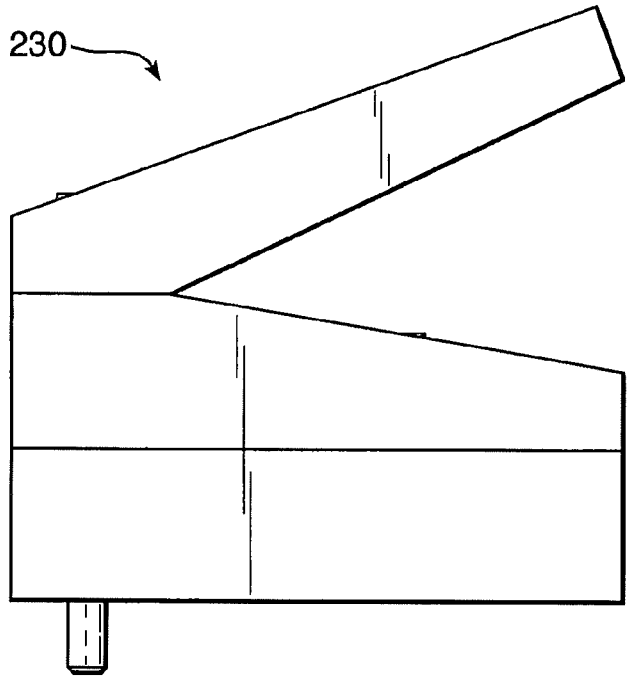
FIG. 20 is a side view diagram of the wing support of the support frame of FIGS. 15 to 18 according to a preferred embodiment of the invention.
Figure 21:
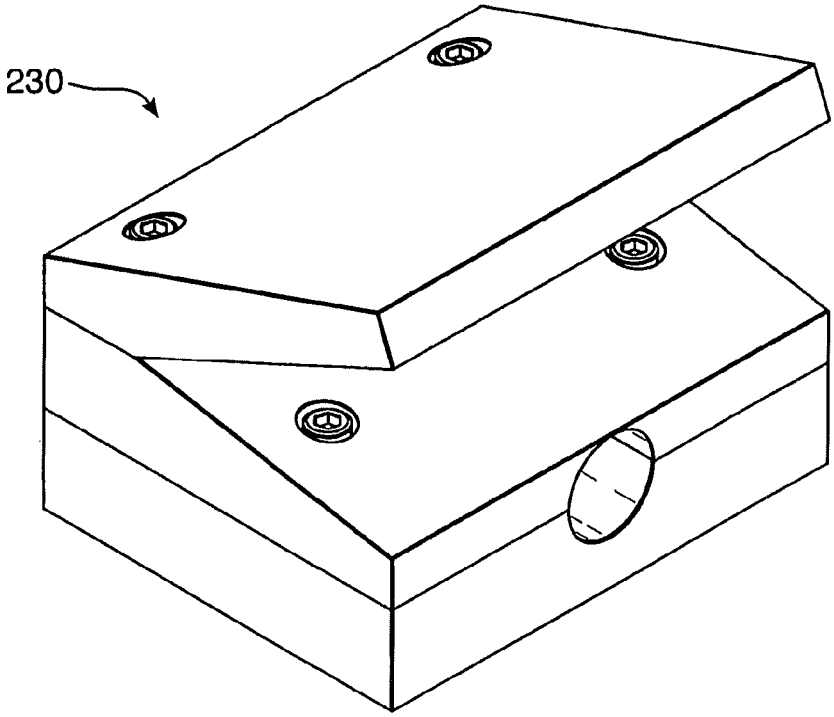
FIG. 21 is a perspective view diagram of the wing support of the support frame of FIGS. 15 to 18 according to a preferred embodiment of the invention.
Figure 22:
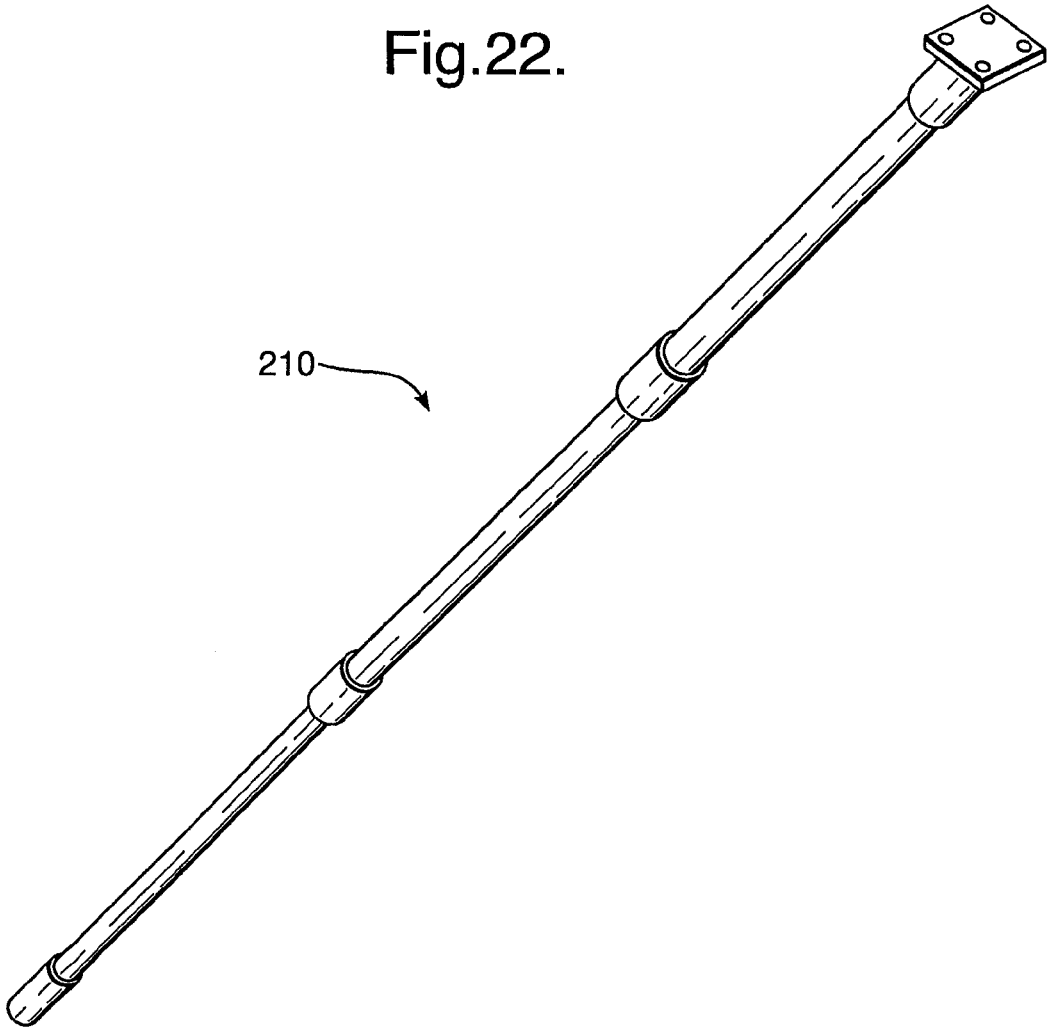
FIG. 22 is a diagram of a telescopic leg of the support frame according to a preferred embodiment of the invention.
Figure 23:
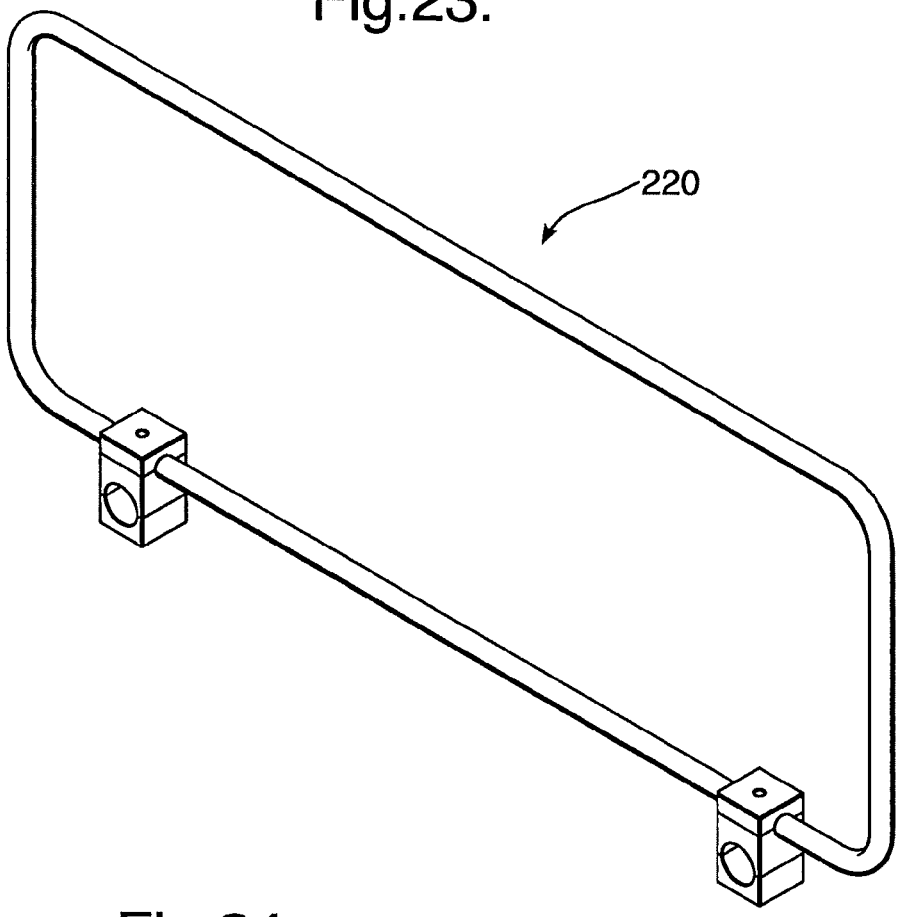
FIG. 23 is a diagram of a folding side of the support frame according to a preferred embodiment of the invention.

FIGS. 16, 17, 18 and 19 show an alternative mounting means that would replace the take-off runners 30 with a stand-alone frame 200 that is positioned above the mortar launcher 50. The frame 200 can be folded to allow it to fit into restricted spaces. The frame 200 is mounted on four telescopic legs 210 (shown in more detail in FIG. 22), to allow for it to be set up on substantially non-flat surfaces. It has two folding sides 220 (shown in more detail in FIG. 23) that are folded out in a C shape to provide the largest clearance for a UAV 20 mounted on top of the mortar launcher 50, using two blocks 240 that have a circular groove therein to fit on top of the mortar barrel (shown in more detail in FIG. 24), in order to give maximum clearance for any rear-mounted propellers. Each folding side 220 has a wing-shaped wedge 230 (shown in more detail in FIGS. 20 and 21) mounted roughly centrally that mates with the rear of the each wing of the UAV 20 such that the UAV 20 is supported by its wings on the folding sides and prevented from sliding backwards down the folding sides 220 by the wing-shaped wedges 230 mating with the rear of each wing. FIGS. 12 to 15 show the frame 200 when arranged over a mortar launcher 50 and with a UAV 20 in place.

Figure 24:
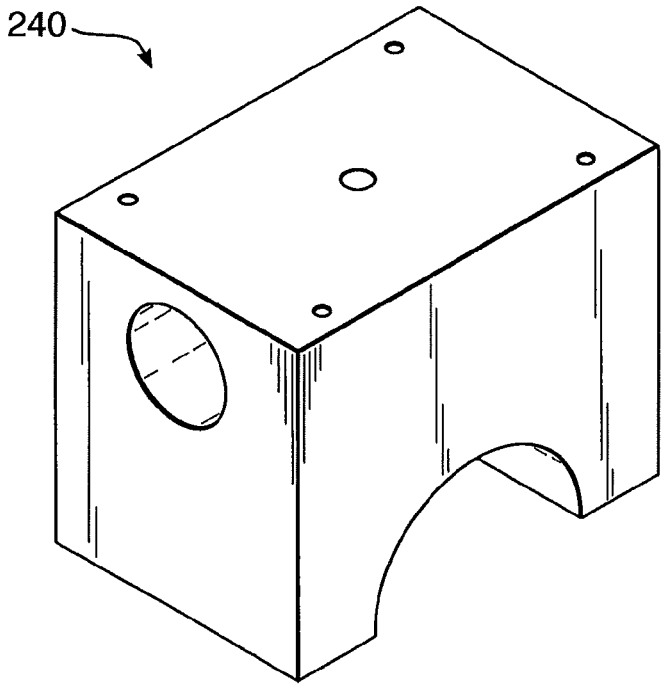
FIG. 24 is a diagram of one of the mortar mounting blocks of the support frame according to a preferred embodiment of the invention.
Figure 32:
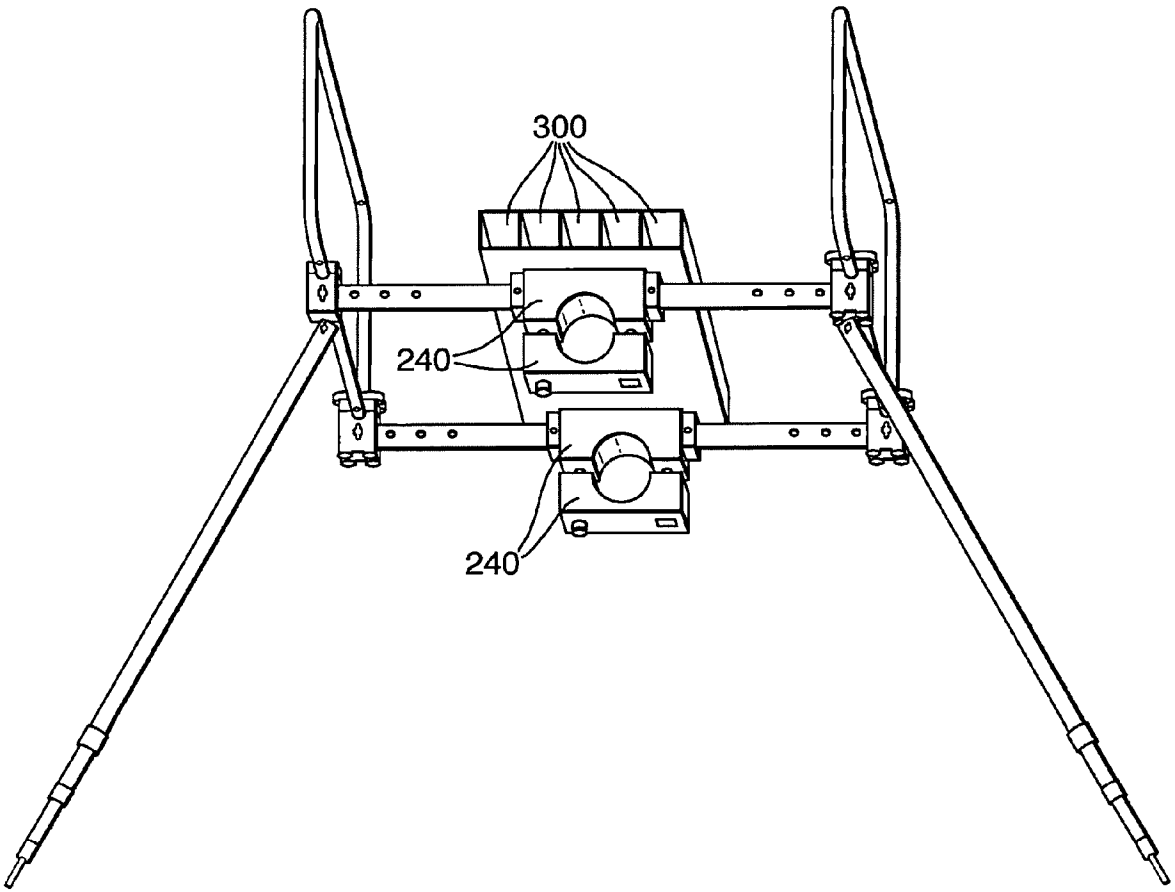
FIG. 32 is a diagram showing an alternative embodiment having a stand made from wood, metal and pipes.

It should be noted that it is preferable to secure the frame to the mortar barrel and that this can be done by using two of the blocks 240 shown in FIG. 24 fastened together clamping the barrel between them and this is shown in FIG. 32.

Figure 30:
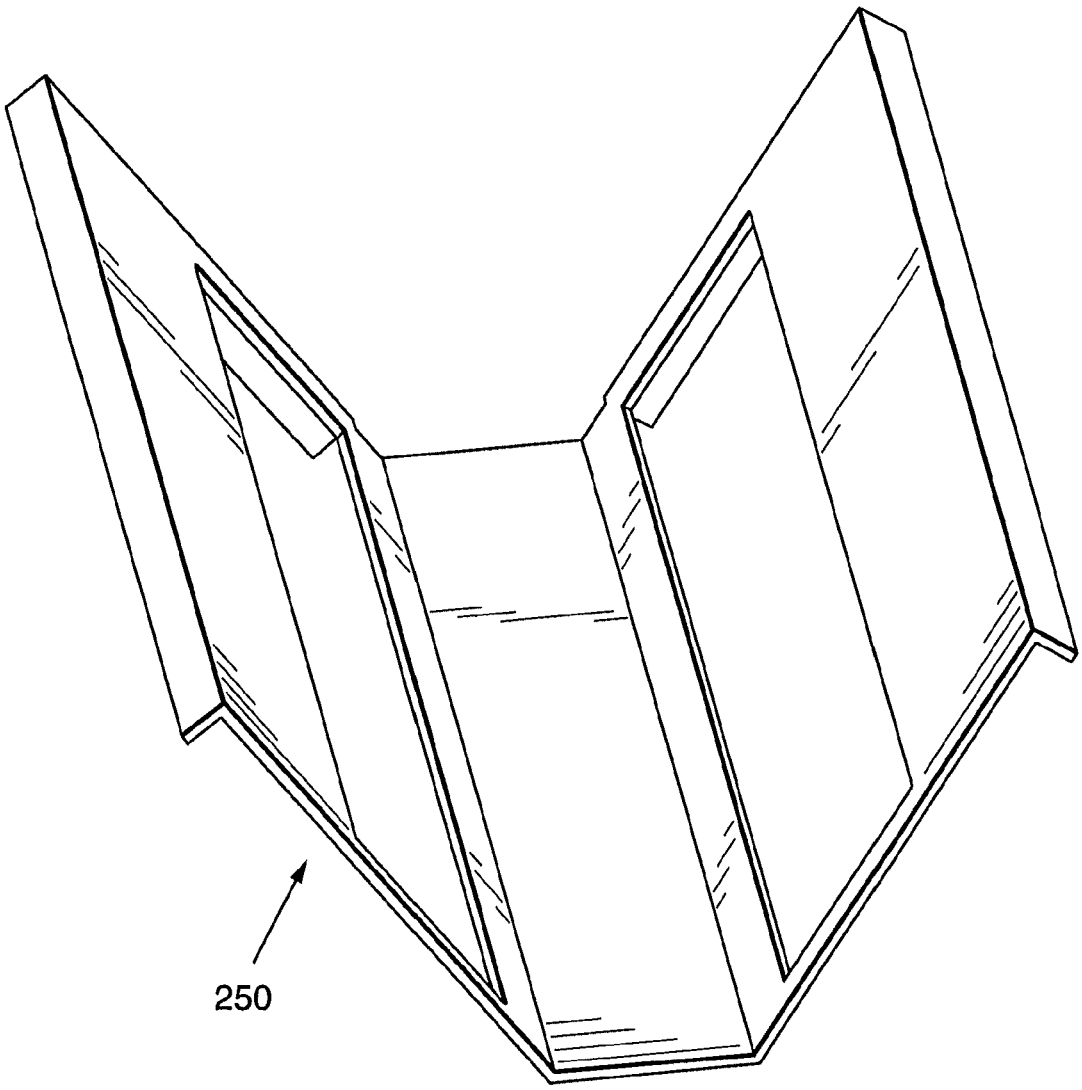
FIG. 30 is a diagram of a butterfly support arrangement according to an alternative embodiment of the invention.
Figure 31:
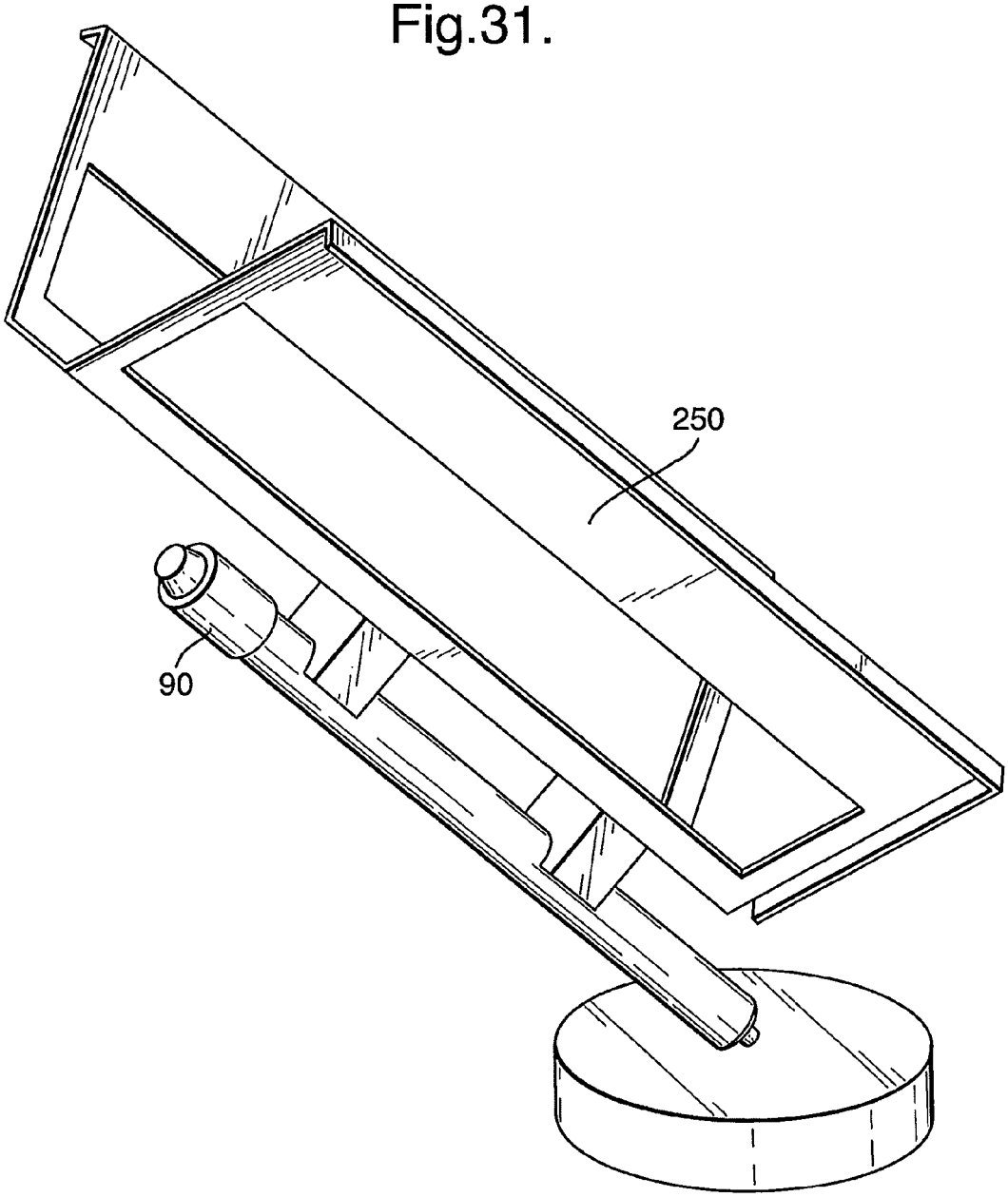
FIG. 31 is a diagram of the butterfly support arrangement of FIG. 30 mounted on a mortar launcher.

Finally, alternative embodiments of the invention will be described:

FIGS. 30 and 31 show an alternative mounting means that would replace the take-off runners 30 with a butterfly launch platform 250. This is formed from two substantially flat rectangular sheets that are hinged along their longer sides and where the hinged portion is mounted on the mortar tube 50 as shown in FIG. 31. The two rectangular sheets are angled relative to each other, the free edges of each sheet thus forming a support for the wings of a UAV 20. It is anticipated that the butterfly launch platform 30*a* can be made as a fixed, unhinged, arrangement or a curved arrangement but a hinged arrangement is preferred over these other arrangements as the apparatus can then be disassembled and folded up if it is hinged. It should also be noted that the frame needs some method for supporting the UAV wings from sliding backwards off the frame, such as the wing supports shown in FIGS. 20 and 21 which prevent the wings sliding backwards off the frame, or a similar mechanism.

It should be noted that the invention could be used to launch both air, underwater and sea vehicles from ships as well as launching a UAV 20 from a ground position.

Other forms of cap 90 are conceivable, the important features being a mating surface or some mechanism for mating with, engaging or capturing the momentum of the mortar shell 80 when it is launched and some means by which to connect the shock cord 40 to this cap 90. Another example would be, instead of a cap, a net made of, for example, reinforced Kevlar strands which covers the muzzle of the mortar launcher and which is provided with some means of connection to the shock cords. As such a more generic term for the cap 90 would be a mating component as this can then cover such a net, as well as different designs of cap. An important factor in alternative designs of cap 90 is that it is preferable to provide for the air inside the mortar tube 50 to escape when the mortar shell 80 is launched from the mortar tube 50 as while designs will work if enough air can escape, the design will be more optimal if there is little resistance to the air escaping as per the preferred cap 90 design described above.

Figure 33:
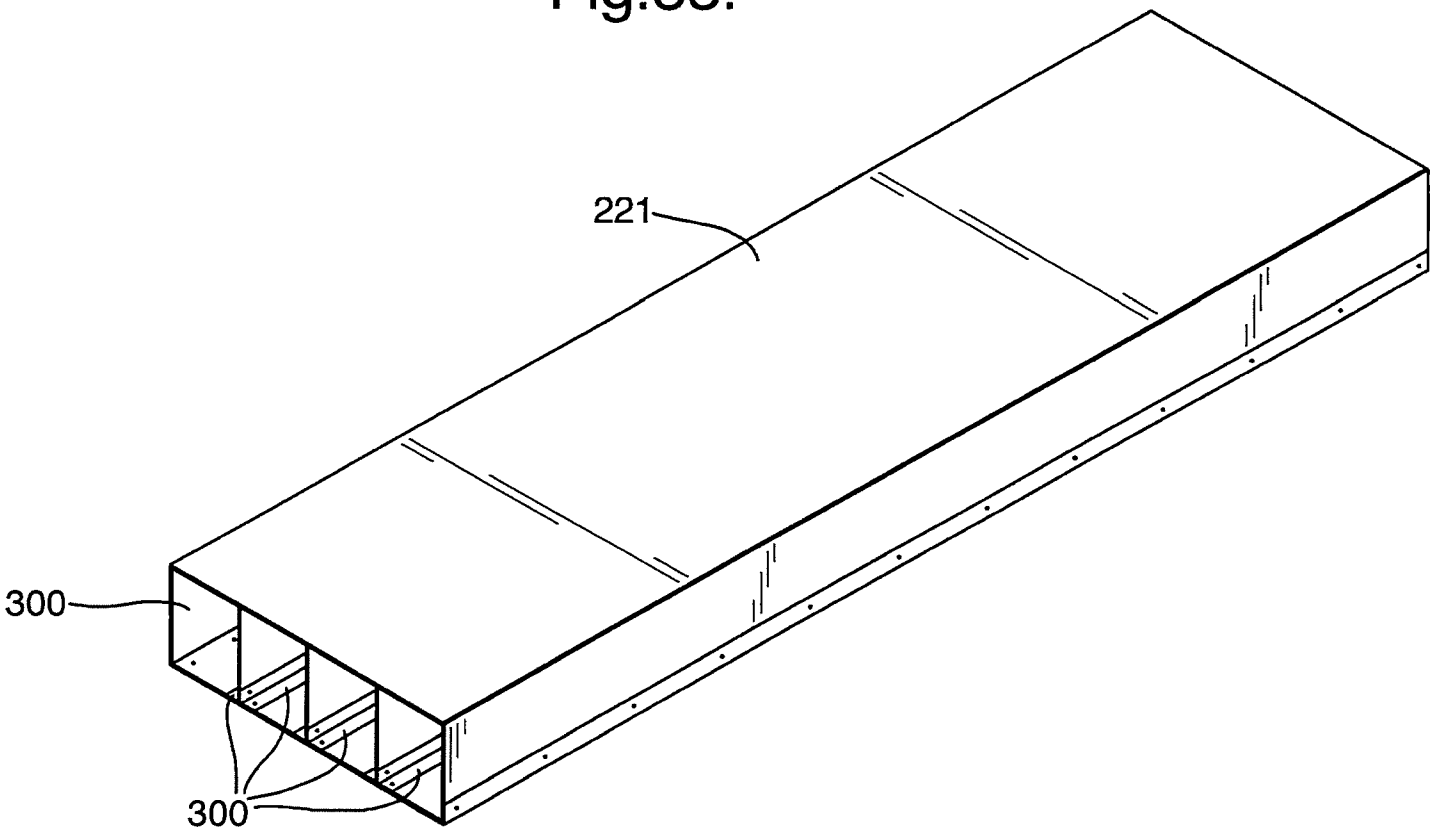
FIG. 33 shows in more detail the platform section of the stand of FIG. 32.
Figure 34A:
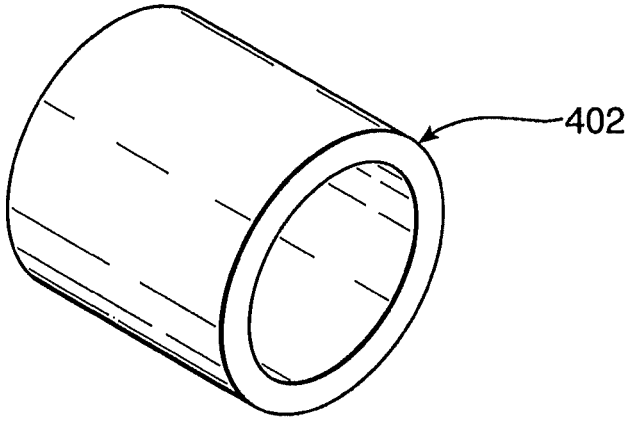
Figure 34B:
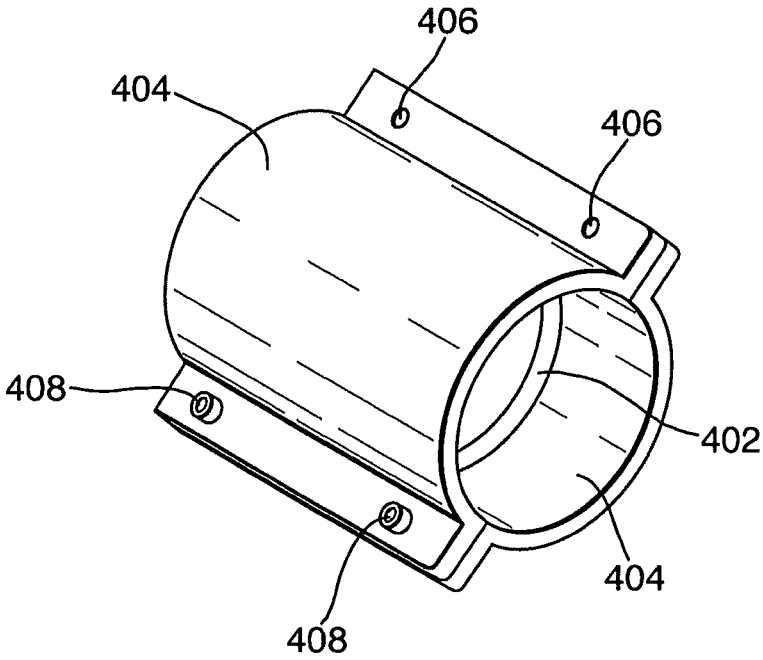
Figure 34C:
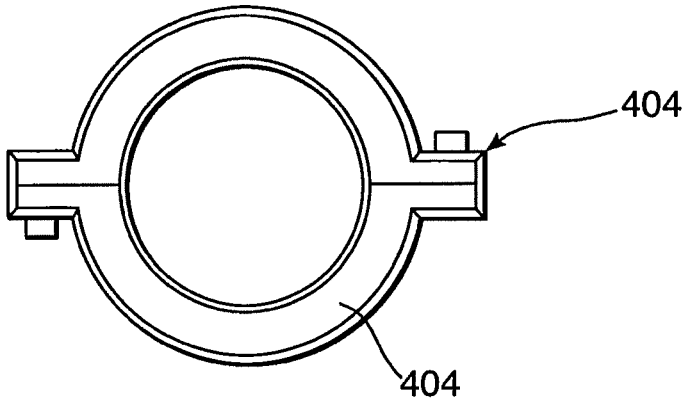
Figure 34D:
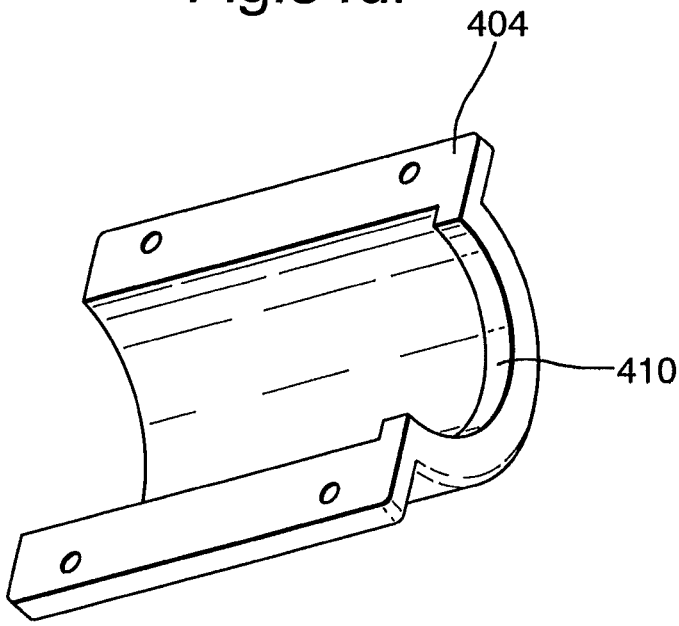

An alternative and preferred embodiment of frame is shown in FIGS. 32 and 33, which is a slightly modified version of the frame of FIGS. 16, 17, 18 and 19. Here several tubes 300 are used to form the platform 221 between the mortar tube 50 and the UAV 20 in order to provide somewhere for the shock cord 40 to be stowed. By stowing the shock cord 40 in these tubes 300, the shock cord 40 is not in the way of anything during launch and will feed out naturally when the mortar shell 80 leaves the mortar tube 50. The platform 221 can be made from several round or preferably square tubes 300 secured together or specially manufactured to be formed as a single block of circular or square tubes 300.

The stand can be made from wood or metal and/or commercially available pipes or a combination of wood and metal and/or commercially available pipes to reduce the cost of the stand.

It should also be noted that starting the propulsion means of the UAV 20 before launching it using the method of the invention reduces the force needed to launch the UAV 20, and thus also increases the weight of UAV 20 that it is possible to launch using this method. It is also possible, however, to use this method to launch a UAV 20 without having the propulsion means on until the UAV 20 is in the air.

In an alternative embodiment, there is provided two different re-usable caps:

The first reusable cap is shown in FIGS. 34*a*, 34*b*, 34*c* and 34*d*, and is formed from a hollow cork cylinder 402 and two metal half-rings 404. The hollow cork cylinder 402 has a tapered inner diameter as per the cap 90 described above. The half rings 404 have lips extending outwards along their length with bolt or screw holes therein 406. The half rings 404 are fastened together with bolts or screws 408 through these holes 406, capturing the hollow cork cylinder 402 in between the two half rings 406. This forms a cylindrical cap, similar to cap 90 but with a cork inner diameter that will form an interference fit with a mortar shell 80 and thus will work in place of cap 90 with the above and below described embodiments. The half rings 404 are also provided with a lip 410 extending inwards along the inside circumference of one end of their length. This lip 410 prevents the hollow cork cylinder 402 from sliding out of the half rings 404 when in use and the hollow cork cylinder 402 is to be positioned with its narrowest diameter end abutting the lip 410. The hollow cork cylinder 402 can then be used once but the two metal half rings 404 can be detached from the hollow cork cylinder 402 and re-used with another hollow cork cylinder 402.

The second reusable cap is shown in FIGS. 35*a*, 35*b*, and 35*c*, and is formed from a single hollow cylindrical rubber sleeve 502 with a slit 506 down the length of the sleeve 502; and a hinged metal cylindrical sleeve 504, which is designed to fit over the rubber sleeve 502. The non-hinged side of the metal sleeve 504 is provided with two lips 514 with bolt/screw holes 508 therein to enable the metal sleeve 504 to be fastened together around the rubber sleeve 502. Use of a hinge 512 enables the rubber sleeve 502 to be captured by the metal sleeve 504. The rubber sleeve 502 is formed with an indent 516 in the shape of the metal sleeve 504 so that the metal sleeve can be fastened around the rubber sleeve 502 in this indent 516 to prevent the metal sleeve 504 becoming detached by sliding off the rubber sleeve 502. The rubber sleeve 502 could be formed without a slit 506, but having a slit 506 means that it is reusable as it can be detached from the mortar shell 80 once the metal sleeve 504 has been removed. The rubber sleeve 502 is provided with a decreasing diameter, tapering from one end to the other, to form an interference fit with a mortar shell 80.

Both of the re-usable caps have interchangeable components, so a hollow cork cylinder 402 could be used with a hinged metal sleeve 504 with minor modification, e.g. inclusion of a lip 410 on the metal sleeve 504; and the rubber sleeve 502 (with or without slit 506) could be used with the two semi-cylindrical half rings 404 with minor modifications, e.g. to remove the lips 410. Both of the re-usable caps are broadly similar to the normal single-use cap 90, in that they cause an interference fit with a mortar shell 80 by having a tapered inner diameter either by a simple step decrease in diameter or by having a gradient decrease in diameter.

In FIG. 36, there is shown an alternative embodiment which uses a throw bag 550 to store the shock cord 40 in a coiled arrangement. Storage in this way prevents the shock cord 40 being caught on something during the mortar launch or becoming tangled while in storage or transit. The throw bag 550 allows the shock cord 40 to feed out of the throw bag 550 during launch of the mortar round 80. The shock cord 40 must not be twisted when stored in the throw bag 550 otherwise it may become tangled upon launch. A loose closure 552 can be used around the top of the throw bag 550 to prevent the shock cord falling out while it is in storage or transit.

Another means for connecting the shock cord 40 to the UAV 20 is by use of a glider release latch instead of a hook. Other means are envisaged, including an electronic release mechanism triggered by either a time or by force measurements, but the important feature is that the release occurs before or at the point when the mortar ceases to pull the UAV 20 forwards and instead acts as drag.

In FIG. 37, there is shown a hook retention mechanism 600 that prevents the shock cord 40 becoming detached from the UAV 20 before or during launch. The hook retention mechanism 600 comprises a hollow tube 602 with one end provided with a stopper 606 and the other end mounted to the platform 221 between the UAV 20 and the mortar tube 50 using a spring loaded hinge 604. The stopper 606 has therein a hole substantially the diameter of the hook 120 located on the underside of the UAV 20. The spring loaded hinge 604 is biased to move the hollow tube 602 flat against the platform 221. The end of the hollow tube 602 provided with the stopper 606 is designed to mate with the hook 120 provided on the bottom of the UAV 20 and to which the shock cord 40 is connected using the ring 140. Once the hollow tube 602 has been pulled away from the platform 221 and the hook 120 inserted into the stopper 606, hollow tube 602 thus prevents the ring 140 sliding off the hook 120 until the mortar shell 80 is launched as the stopper 606 and hollow tube 602 don't release the hook 120 unless the UAV 20 is moving in the direction it will be launched. When the UAV 20 launches, the shock cord 40 will be pulling the UAV 20 and thus the ring 140 cannot come off once this force is being exerted, as it is being pulled by the mortar shell 80 and thus pulling on the hook 120, and this is when the hook 120 is pulled out of the hollow tube and stopper 606. The hollow tube 602 is preferably made from plated copper, the metal loop 140 is preferably a metal ring of 33 mm inner diameter, and the stopper 606 is preferably made from plastic and has an inner diameter greater than 33 mm.

It should be noted that instead of using a latch 100, one can angle the stand on which the UAV 20 sits to be at suitable angle to achieve effect of latch 100 as the force pulling the UAV 20 needs to overcome the component of gravity acting on the UAV 20 at rest, thus providing the same effect as latch 100.

It should also be noted that the stands disclosed above that can be moved can be mounted at a position slightly behind the mortar tube 50, thus not clamped to the mortar tube 50, to enable the UAV 20 to experience a better angle of attack when being launched.

The shock cord 40 could be replaced with other means, such as a spring. It should be noted that a shock cord 40 is a form of biased resilient means and a common example of a shock cord 40 is a bungee rope.

It is also noted that the UK armed forces use an 81 mm mortar while the US armed forces use an 82 mm mortar and that the cap 90 should be easily modified to work with either type of mortar. It is also conceivable to use any of the following methods instead of a mortar launcher to provide the force to accelerate a UAV using the shock cord and cap system described above with some modification: a flare gun, a harpoon, a rocket launcher, a rifle or a machine gun with flywheel/bearing to remove rotational movement and maintain thrust in direction of fire.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An apparatus for launching a winged vehicle, comprising:

a winged vehicle;

a projectile;

a projectile launching means; and a projectile momentum converting means for converting projectile momentum into acceleration of said winged vehicle and including a mating component that engages said projectile, wherein said mating component is configured to harness said projectile when said projectile is launched, and is connected with a biased resilient means to said winged vehicle.

2. The apparatus according to claim 1, wherein said mating component is configured to harness said projectile using an interference fit.

3. The apparatus means according to claim 1, wherein said mating component is configured to harness said projectile using one or more contacting surfaces.

4. The apparatus according to claim 3, wherein said contacting surfaces are formed with a tapered inner diameter operable to form an interference fit with said projectile.

5. The apparatus according to claim 1, wherein the mating component comprises an air escape vent.

6. The apparatus according to claim 1, wherein said mating component comprises one or more mounting points.

7. The apparatus according to claim 6, wherein said one or more mounting points is used to connect said biased resilient means to the mating component.

8. The apparatus according to claim 7, wherein said one or more mounting points are used to connect the biased resilient means to the mating component using one or more reinforced crimp fitted cables.

9. The apparatus according to claim 1, wherein said mating component is suitable for mounting at the muzzle of a barrel.

10. The apparatus according to claim 1, wherein said mating component is formed as one or more portions operable to be fastened together.

11. The apparatus according to claim 10, wherein said mating component is configured to accept an inner portion configured to provide an interference fit with said projectile.

12. The apparatus according to claim 1, wherein the biased resilient comprises a shock cord.

13. The apparatus according to claim 1, wherein the winged vehicle is mounted on a frame positioned above the projectile launching means.

14. The apparatus according to claim 13, wherein the frame is secured to the projectile launching means.

15. The apparatus according to claim 1, wherein a stowing mechanism is provided for the biased resilient means.

16. The apparatus according to claim 1, wherein a biased retention means is provided to maintain the connection of the biased resilient means to the winged vehicle until the winged vehicle is launched.

17. The apparatus according to claim 1, wherein a retention means is provided to maintain the position of the winged vehicle relative to the projectile launching means until the vehicle is launched.

18. A method for launching a winged vehicle using a mating component as claimed in claim 1, the method comprising:

(i) launching a projectile; and (ii) converting the projectile momentum into acceleration of a winged vehicle.

* * * * *